US008012074B1

(12) United States Patent
Signorile et al.

(10) Patent No.: US 8,012,074 B1
(45) Date of Patent: Sep. 6, 2011

(54) STABILITY BALL CONTROL DEVICE WITH RADIAL CONTROL SURFACES OF INCREASING WIDTHS

(75) Inventors: Joseph F. Signorile, Miami, FL (US); Samuel S. Hollander, Coral Gables, FL (US)

(73) Assignee: Concept One International LLC, Coral Gables, FL (US)

( * ) Notice: Subject to any disclaimer, the term of this patent is extended or adjusted under 35 U.S.C. 154(b) by 0 days.

(21) Appl. No.: 13/079,574

(22) Filed: Apr. 4, 2011

Related U.S. Application Data

(62) Division of application No. 12/847,566, filed on Jul. 30, 2010, now Pat. No. 7,942,796.

(51) Int. Cl.
*A63B 26/00* (2006.01)

(52) U.S. Cl. ..... 482/142; 482/143; 482/148

(58) Field of Classification Search ..... 482/110, 482/129, 130, 140, 142, 148; 446/220
See application file for complete search history.

(56) References Cited

U.S. PATENT DOCUMENTS

| | | | | |
|---|---|---|---|---|
| 3,586,321 | A | 6/1971 | Gehrke | |
| 6,730,005 | B1 | 5/2004 | Liao | |
| D521,084 | S * | 5/2006 | Huang | D21/662 |
| 7,344,487 | B2 | 3/2008 | Carter et al. | |
| 7,674,216 | B1 * | 3/2010 | Bolling | 482/142 |
| 7,691,036 | B1 | 4/2010 | Julian et al. | |
| 7,901,339 | B2 * | 3/2011 | Schechter | 482/142 |
| 2007/0066461 | A1 | 3/2007 | Carter et al. | |

FOREIGN PATENT DOCUMENTS

| | | |
|---|---|---|
| CA | 2410704 | 5/2004 |
| DE | 9010548 | 11/1990 |

OTHER PUBLICATIONS

International Search Report of PCT/US10/44043, Sep. 16, 2010.
Marshall, Paul W., et al., "Core Stability Exercises On and Off a Swiss Ball," Arch Phys Med Rehabil vol. 86, Feb. 2005, 242-249.
Marshall, Paul W., et al., "Increased Deltoid and Abdominal Muscle Activity During Swiss Ball Bench Press," Journal of Strength and Condition Research, 2006, 20(4), 745-750.
Stanton, Robert, et al., "The Effect of Short-Term Swiss Ball Training on Core Stability and Running Economy," Journal of Strength and Conditioning Research, 2004, 18(3), 522-528.
Willardson, Jeffrey M., "Core Stability Training: Applications to Sports Conditioning Programs," Journal of Strength and Conditioning Research, 2007, 21(3), 979-985.

* cited by examiner

*Primary Examiner* — Glenn Richman
(74) *Attorney, Agent, or Firm* — Maybeck & Hoffman, P.A.; Gregory L. Mayback; Rebecca A. Tie

(57) ABSTRACT

An exercise device includes a body having rib-like structures and an annular band. Each rib-like structure has an exterior surface defining a longitudinal extent, terminates at a radiating end, and has at least one wing formed substantially parallel to the longitudinal extent and protruding away from the exterior surface to a given distance that increases along a direction towards the radiating end. The rib-like structures overlap at a central point to comprise a central base. The annular band is connected to the radiating end of each rib-like structure such that the rib-like structures and the band together form a cup-shaped enclosure operable to seat therein a bottom portion of an exercise ball. The at least one wing of each rib-like structure is operable to provide an incremental resistance against a rolling movement of the exercise ball along a substantially flat surface when the exercise ball is seated therein.

18 Claims, 26 Drawing Sheets

STABILITY BALL CONTROL DEVICE WITH RADIAL CONTROL SURFACES OF INCREASING WIDTHS

CROSS-REFERENCE TO RELATED APPLICATIONS

This application is a divisional application of U.S. patent application Ser. No. 12/847,566 to Signorile et al. (which application claims the priority, under 35 U.S.C. §119, of U.S. Provisional Patent Application Ser. No. 61/230,348, filed Jul. 31, 2009), the entire disclosures of which are hereby incorporated herein by reference in their entirety.

FIELD OF INVENTION

The present invention lies in the field of core training exercise equipment. More specifically, the present disclosure relates to a "cage" or "enclosure" that is comprised of widening rib-like elements (e.g., six) that radiate from the base of an exercise stability ball and attach to a belt that surrounds the ball just below the ball's circumference. Protruding from each rib-like element is at least one constantly widening inclined plane or wing that forces the enclosed ball back to its base position and increases the resistance as the ball rolls away from that base position.

BACKGROUND OF THE INVENTION

Core training has developed into one of the most important concepts in fitness training. Exercise scientists, biomechanists, physical therapists, strength and conditioning coaches and personal trainers all realize the critical link that the central or "core" muscles play in stabilizing the trunk (especially, the lower back) and transferring force and power from the legs to the upper body musculature. One of the most important and commonly used pieces of equipment employed during core training is the stability ball, sometimes referred to as the "Swiss ball." Like the prior-art device shown in FIG. 1A, stability balls provide a rolling or unstable surface on which exercises are performed. The instability of the ball requires the exerciser to compensate during the exercise using his or her musculature to maintain control of the ball throughout the exercise. A primary benefit of exercise ball training, as opposed to exercising on a hard flat surface, is that the body responds to the instability of the ball to remain balanced thereby engaging many more muscles. Those muscles become stronger over time to keep balanced. Most frequently, the "core" body muscles are the focus of exercise ball programs.

However, the stability ball has two major flaws. The first, and perhaps the most pressing because it prevents many persons from using the ball and more advanced users from performing advanced exercises, is the tendency of the ball to roll away from the user. This tendency adds an element of fear that precludes the utilization of stability balls by many potential users. The second flaw is that the stability ball offers no changes in resistance to movement throughout the range of motion of the exercise. In addition, the resistance offered by the ball decreases as it becomes increasingly unstable at the end ranges of an exercise.

Scientific literature has demonstrated the positive impact of stability ball training on neuromuscular function over the past decade and the support in the literature has increased significantly over the last five years. See, e.g., J. M. Willardson, *Core stability training: applications to sports conditioning programs*, J Strength Cond. Res. 2007 August 21(3):979-985; P. W. Marshall, B. A. Murphy, *Increased deltoid and abdominal muscle activity during Swiss ball bench press*, J Strength Cond. Res. 2006 November 20(4):745-50; P. W. Marshall, B. A. Murphy, Core stability exercises on and off a Swiss ball, Arch. Phys. Med. Rehabil. 2005 February 86(2):242-249; R. Stanton, P. R. Reaburn, B. Humphries, *The effect of short-term Swiss ball training on core stability and running economy*, J Strength Cond. Res. 2004 August 18(3): 522-8. Currently, there are platforms that hold stability balls in place preventing them from rolling (Aeromat Stability Ball Base, STACCA.com) or that are used for storage (Power Systems Inc.), but no device or system exists that allows stabilization of the stability ball while still permitting continued functional core exercising on the ball.

Accordingly, a need exists to overcome the problems discussed above.

SUMMARY OF THE INVENTION

The device of the instant invention provides a unique control system that can maximize the benefit of one of the most important core exercise apparatuses, the stability ball. The inventive device incorporates a "cage" or "enclosure" that is comprised of a plurality of flexible bands that lock into or are integral with a connecting structure to form a radial configuration such that when assembled together, the device encloses the stability ball to control the ball's movement.

With the foregoing and other objects in view, there is provided, in accordance with the invention, an exercise device includes a body having rib-like structures and an annular band. Each rib-like structure has an exterior surface defining a longitudinal extent, terminates at a radiating end, and has at least one wing formed substantially parallel to the longitudinal extent and protruding away from the exterior surface to a given distance that increases along a direction towards the radiating end. The rib-like structures overlap at a central point to comprise a central base. The annular band is connected to the radiating end of each rib-like structure such that the rib-like structures and the band together form a cup-shaped enclosure operable to seat therein a bottom portion of an exercise ball. The at least one wing of each rib-like structure is operable to provide an incremental resistance against a rolling movement of the exercise ball along a substantially flat surface when the exercise ball is seated therein.

With the objects of the invention in view, there is also provided an exercise device, including a body having an annular hub, rib-like structures radiating from the hub and an annular band. Each rib-like structure has an exterior surface defining a longitudinal extent, terminates at a distal radiating end, and has at least one wing formed substantially parallel to the longitudinal extent and protruding away from the exterior surface to a given distance that increases along a direction towards the radiating end. The annular band is connected to the radiating end of each rib-like structure such that the annular hub, the rib-like structures, and the band together form an enclosure operable to surround a bottom portion of an exercise ball seated therein. The at least one wing of each rib-like structure is operable to provide an incremental resistance against a rolling movement of the exercise ball along a substantially flat surface when the exercise ball is seated therein.

With the objects of the invention in view, there is also provided an exercise device including a body having a plate-shaped central base, rib-like structures radiating from the base, and an annular band. Each rib-like structure has an exterior surface defining a longitudinal extent, terminates into a radiating end, and has at least one wing formed substantially parallel to the longitudinal extent and protruding away from the exterior surface to a given distance that increases along a direction towards the radiating end. The annular band is connected to the radiating end of each rib-like structure such that the base, the rib-like structures, and the band together form a cup-shaped enclosure operable to seat therein a bottom portion of an exercise ball. The at least one wing of each rib-like structure is operable to provide an incremental resistance against a rolling movement of the exercise ball along a substantially flat surface when the exercise ball is seated therein.

In accordance with another feature of the invention, the at least one wing is operable to come into rolling contact with the substantially flat surface as the exercise ball is rolled in a direction along the substantially flat surface thereby biasing the exercise ball in a direction opposing the rolling direction of the exercise ball.

In accordance with a further feature of the invention, the diameter of each rib-like structure widens towards the radiating end of the rib-like structure.

In accordance with an added feature of the invention, the annular band is removably secured to the radiating end of each rib-like structure.

In accordance with an additional feature of the invention, the annular hub and/or base has an exterior surface shaped as a portion of a sphere.

In accordance with yet another feature of the invention, the annular band is connected to the radiating end of each rib-like structure such that the rib-like structures are held equally spaced apart from one another.

In accordance with a concomitant feature of the invention, each rib-like structure has a proximal end removably secured to the base and/or the hub.

Additional advantages and other features characteristic of the present invention will be set forth in the detailed description that follows and may be apparent from the detailed description or may be learned by practice of exemplary embodiments of the invention. Still other advantages of the invention may be realized by any of the instrumentalities, methods, or combinations particularly pointed out in the claims. The construction and method of operation of the invention, however, together with additional objects and advantages thereof, will be best understood from the following description of specific embodiments when read in connection with the accompanying drawings.

Although the invention is illustrated and described herein as embodied in a stability ball control device with radial control surfaces of increasing widths, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims.

BRIEF DESCRIPTION OF THE DRAWINGS

Advantages of embodiments of the present invention will be apparent from the following detailed description of the preferred embodiments thereof, which description should be considered in conjunction with the accompanying drawings in which.

DETAILED DESCRIPTION OF THE INVENTION

Figure 1A:
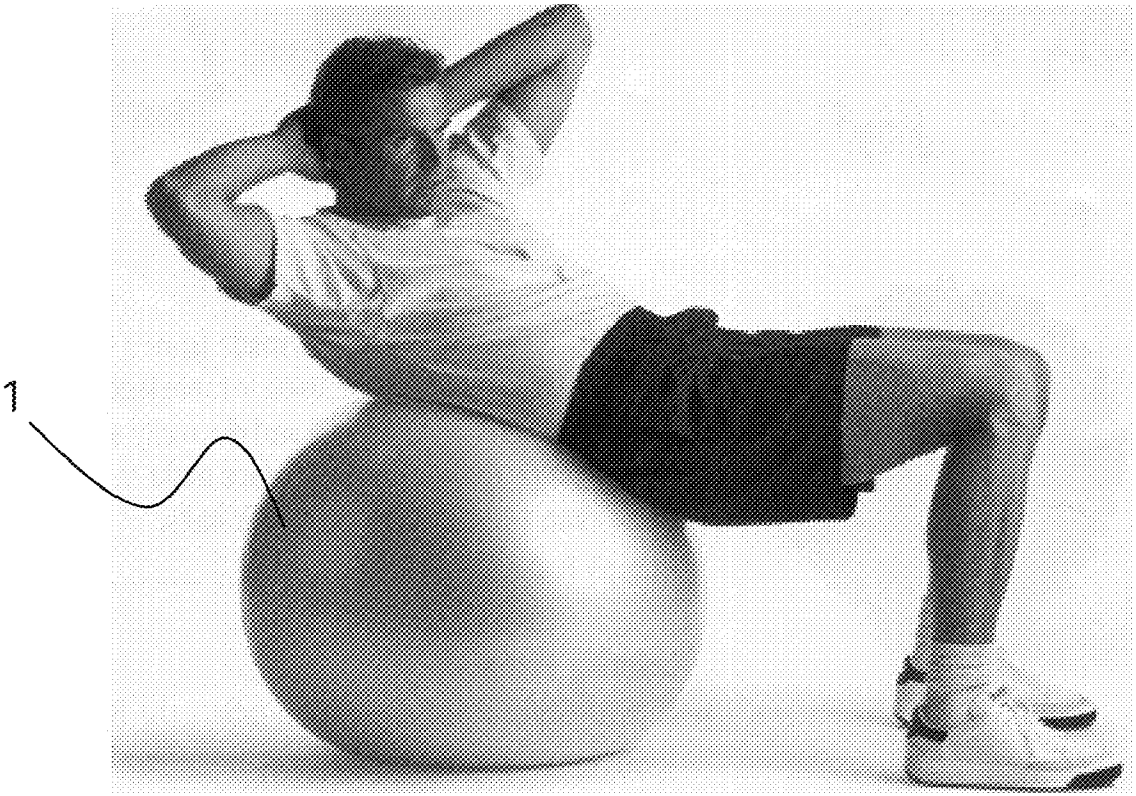
FIG. 1A PRIOR ART
FIG. 1A is a prior-art device stability ball that is incorporated into an exercise movement of the user.
Figure 2:
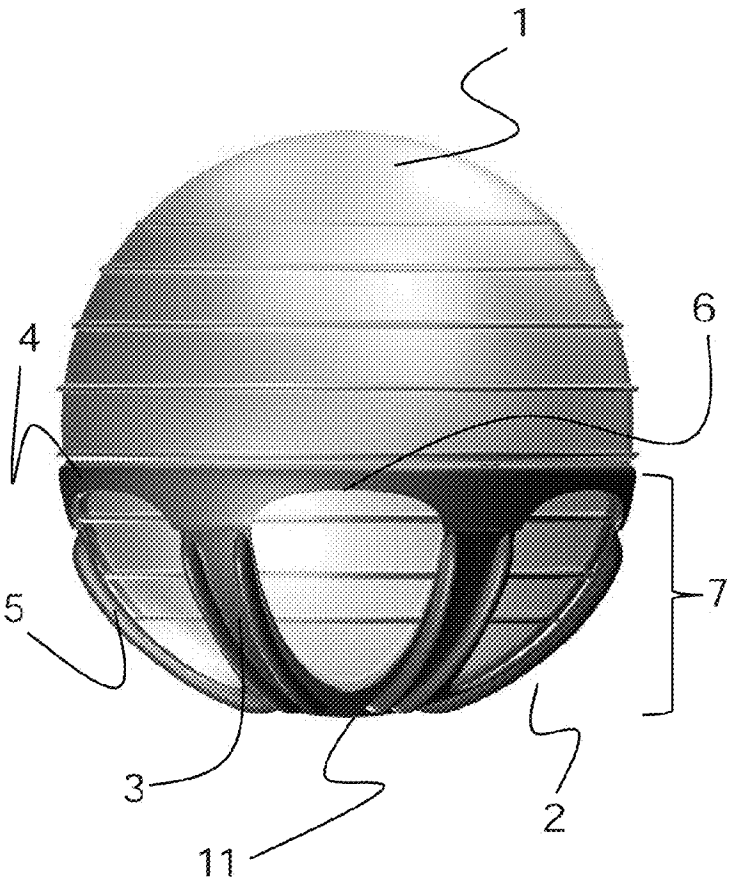
FIG. 2 is a side view of the exercise device of FIG. 1 in a fully assembled configuration and after its application to a stability ball.
Figure 1:
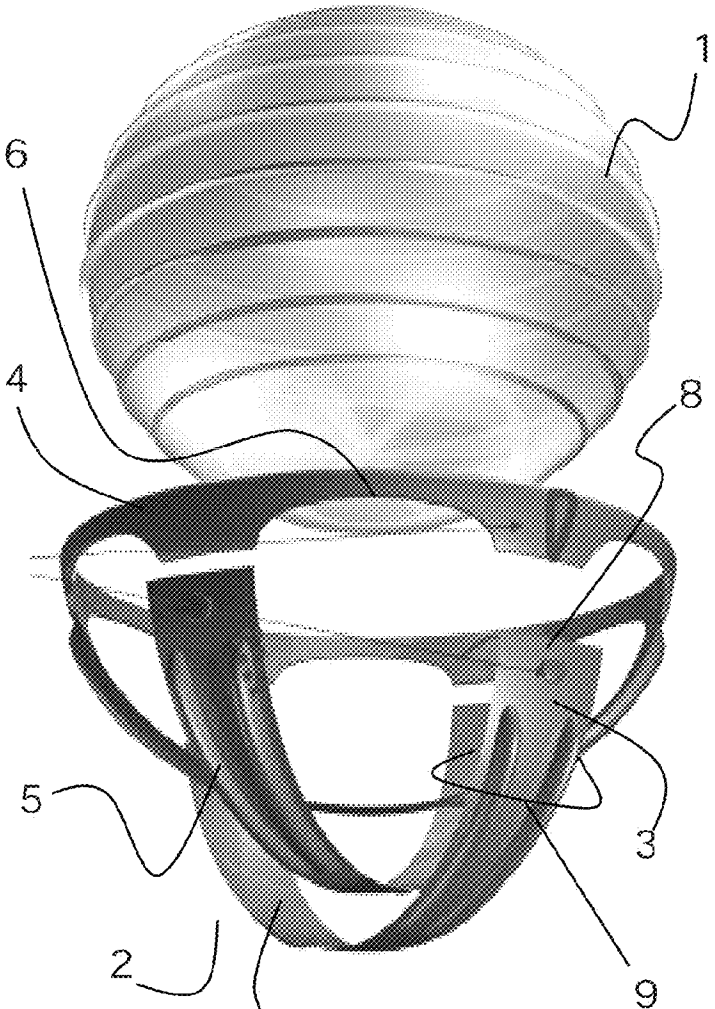
FIG. 1 is an exploded view of a first exemplary embodiment of the exercise device according to the present invention in an unassembled configuration and prior to its application to a stability ball.
Figure 4:
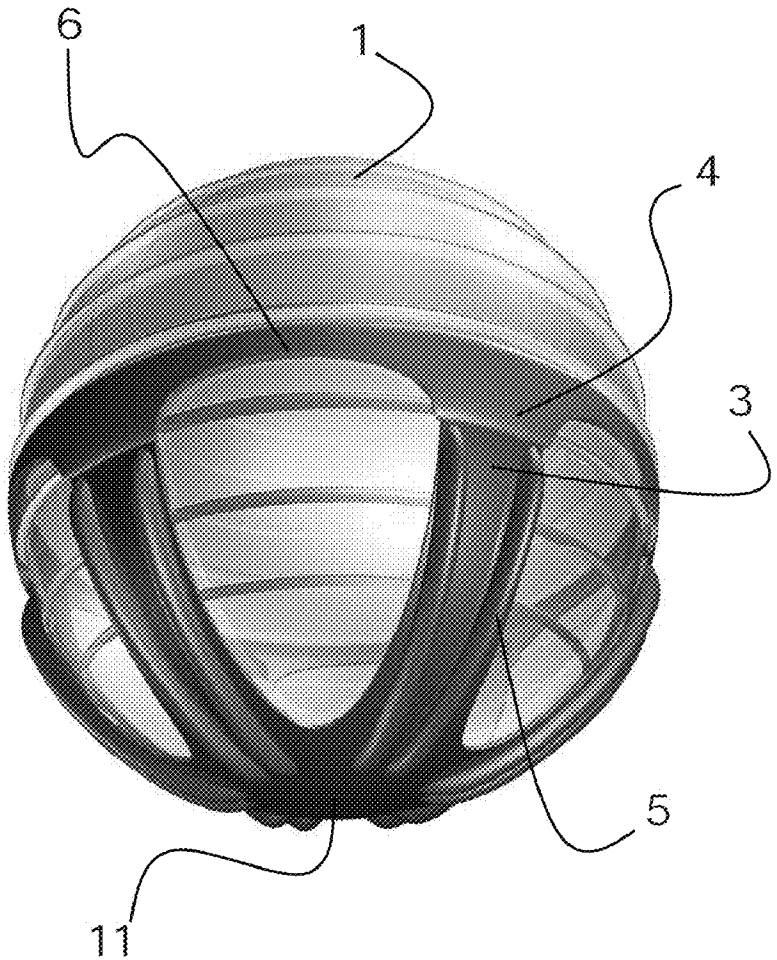
FIG. 4 is a perspective view of the underside of the exercise device of FIG. 2.
Figure 3:
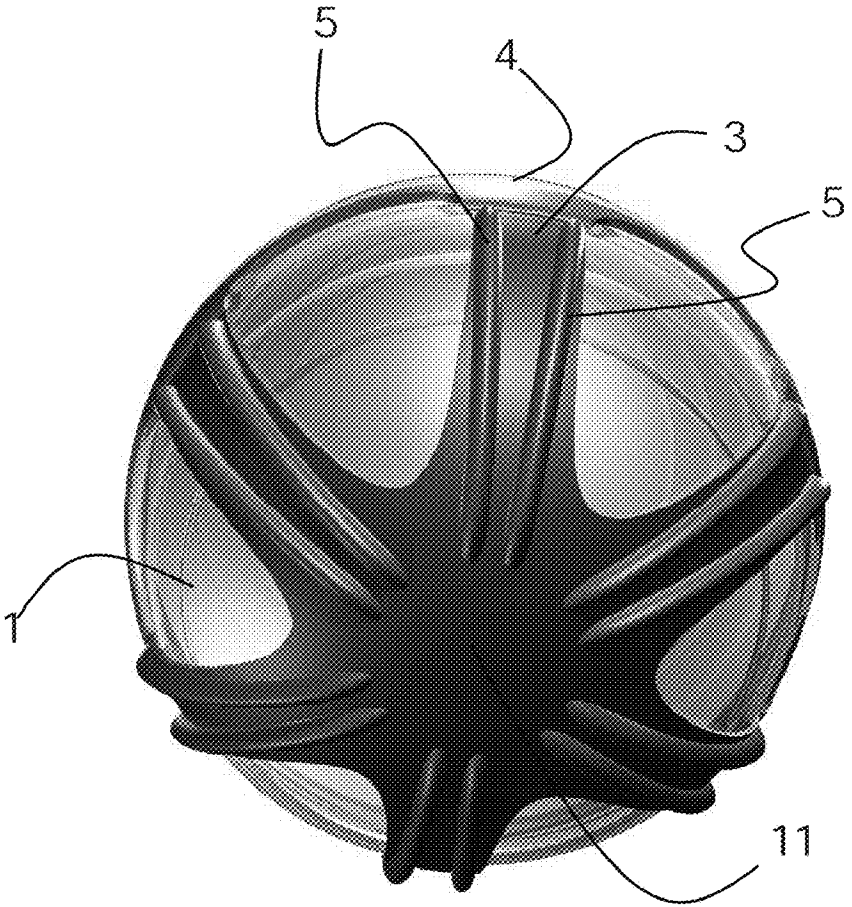
FIG. 3 is a bottom view of the exercise device of FIG. 2.
Figure 6:
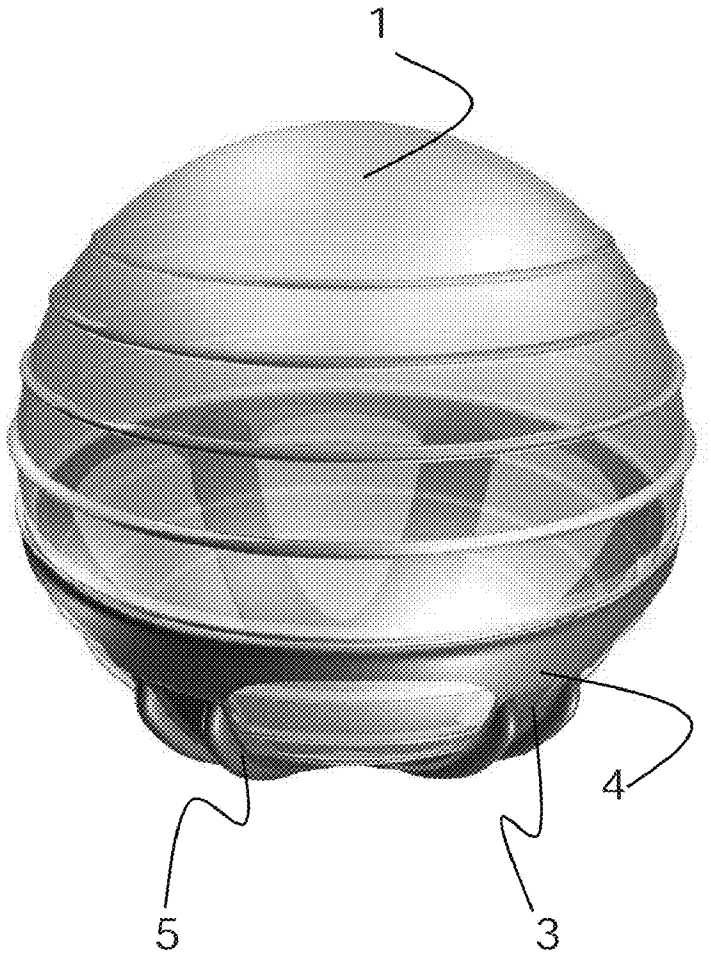
FIG. 6 is a perspective view of the topside of the exercise device of FIG. 2, as well as the interior of the device made visible by the translucency of the stability ball.
Figure 5:
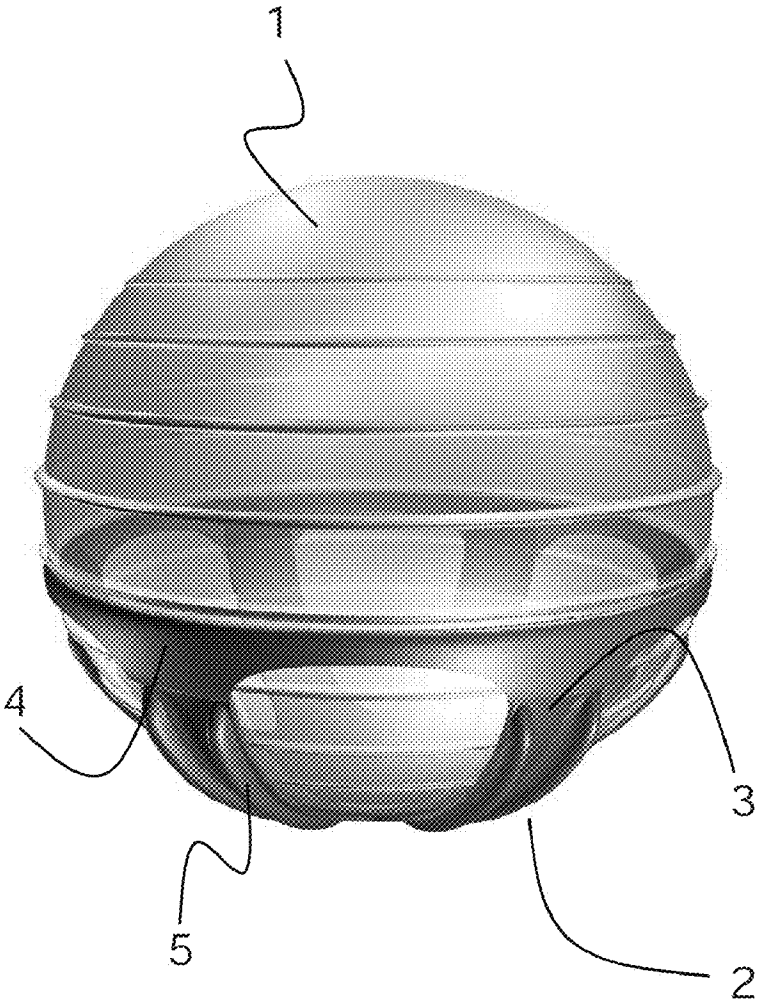
FIG. 5 is a side view of the exercise device of FIG. 2, as well as the interior of the device made visible by the translucency of the stability ball.
Figure 8:
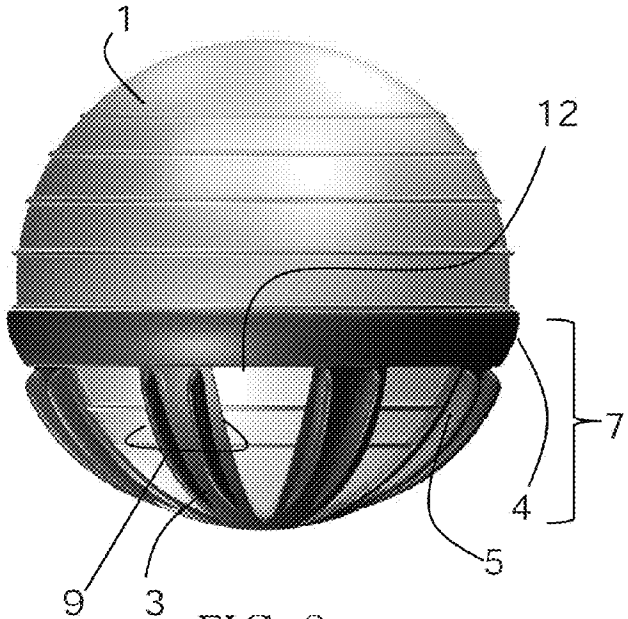
FIG. 8 is a side view of the exercise device of FIG. 7.
Figure 7:
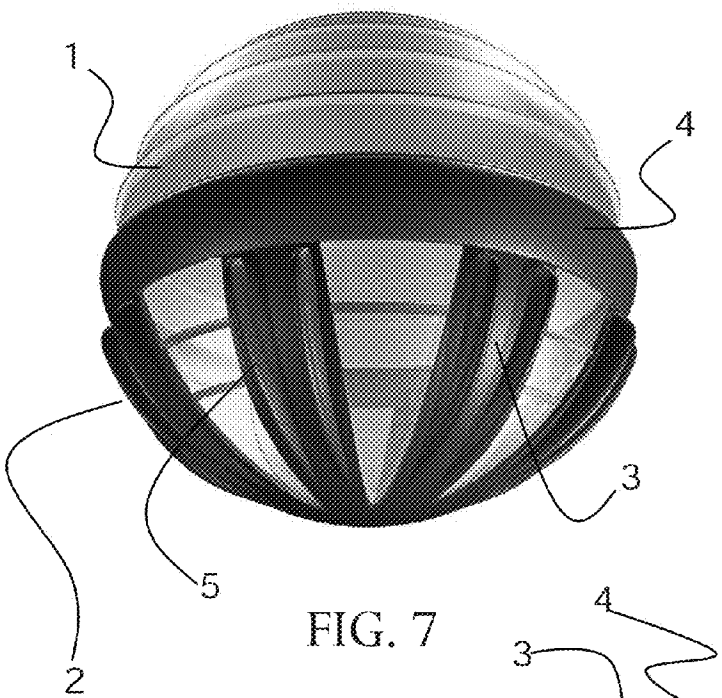
FIG. 7 is a perspective view of the underside of a second exemplary embodiment of the exercise device according to the present invention in a fully assembled configuration and after its application to a stability ball.
Figure 9:
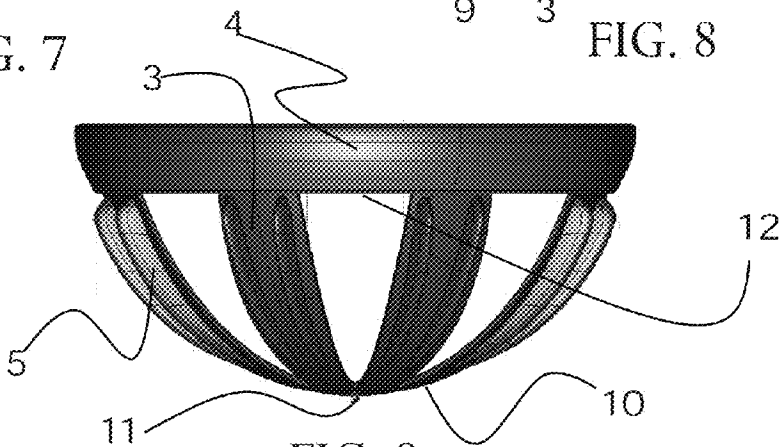
FIG. 9 is a side view of the exercise device of FIG. 7, as it appears when not applied to a stability ball.
Figure 11:
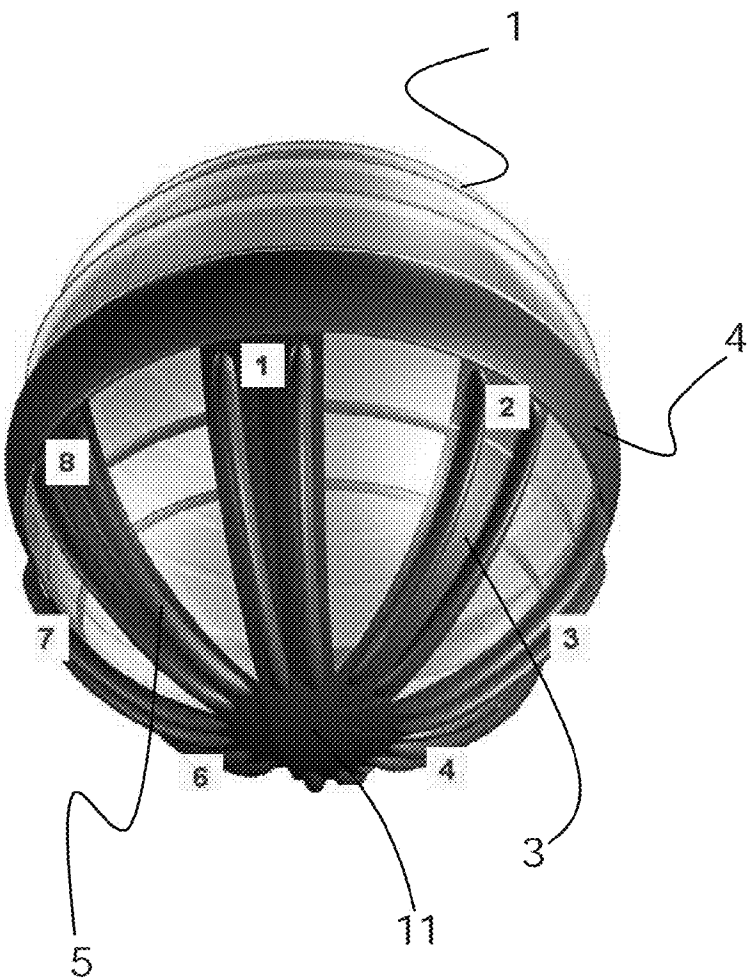
FIG. 11 is another perspective view of the underside of the exercise device of FIG. 7.
Figure 10:
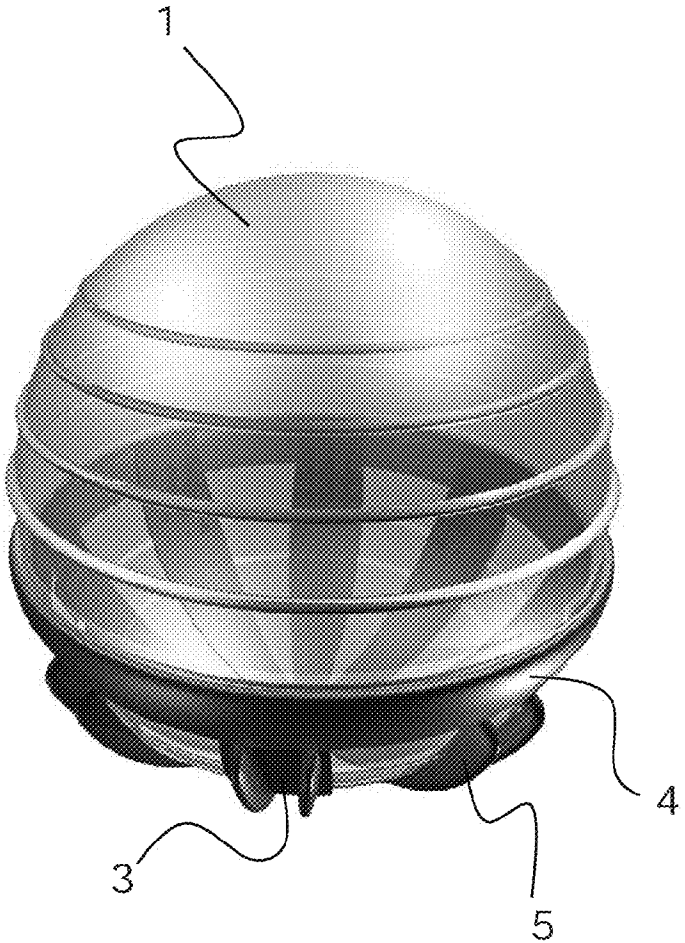
FIG. 10 is a perspective view of the topside of the exercise device of FIG. 7, as well as the interior of the device made visible by the translucency of the stability ball.

As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically.

Relational terms such as first and second, top and bottom, and the like may be used solely to distinguish one entity or action from another entity or action without necessarily requiring or implying any actual such relationship or order between such entities or actions. The terms "comprises," "comprising," or any other variation thereof are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the element.

As used herein, the term "about" or "approximately" applies to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the object being described.

The device of the present invention provides a unique way to control the rollaway movements of a stability ball while simultaneously increasing the resistance being applied to the user's body musculature during exercises being performed by the user with the stability ball. FIG. 1A provides an example of the type of stability ball 1, found in the prior art, that would benefit from the inventive device described herein.

The invention incorporates a "cage" or "enclosure" that is comprised of a plurality of flexible bands, or ribs, that lock into or are integral with a connecting structure to form a radial configuration such that when assembled together, the device cups or encloses a bottom portion of the stability ball to control the stability ball's movement. The flexible bands or ribs have at least one inclined plane or wing on their exterior surface such that when the stability ball is rolled away from its base (i.e., resting) position in any direction along a substantially flat surface, the inclined plane or wing comes into contact with the substantially flat surface to provide an incremental, counteracting or balancing resistance to movement of the ball away from its base position. This resistance is beneficially transferred to the user while the user is performing exercise movements with the stability ball.

Referring now to the figures of the drawings in detail and first, particularly to FIGS. 1-6 thereof, there is shown a first exemplary embodiment of the exercise device according to the present invention. The exercise device 2 is comprised of a plurality of flexible rib assemblies 10, bent into a semicircular arc or a bow to form a plurality of widening ribs 3 in a radial configuration, and held equal distances apart by a circularshaped belt 4 or other connecting structure that surrounds, with a snug fit, the circumference of a stability ball 1 at a height 7 that is, for example, just below or at the midline of the ball. This allows the device to apply resistance and stability throughout the working surface of the ball during most functional exercises. Depending upon the shape of the ball 1, it may be beneficial that the height 7 be above, or just slightly above, the midline of the ball in order to provide a better grip on the ball. It is also envisioned for the height to extend just past the middle plane of the ball and to have the uppermost ball-receiving opening to curve slightly inward. In such an embodiment, with a flexible exercise ball, the exercise device will slightly compress the ball to improve gripping and inhibit ball roll-out during use. Together, the rib assemblies 10 and the belt 4 form a concave-shaped, hemispherical "cage" or "enclosure" of approximately the lower half of the stability ball 1 whereby the stability ball is securely seated inside the device 2. In this exemplary embodiment, the rib assemblies 10 are removably anchored or secured to the belt 4 at their ends 8. Although three rib assemblies 10, resulting in six ribs 3, are shown in this particular embodiment, this is for purposes of a non-limiting illustration only. Depending on the amount of desired resistance to the rollaway movement of the stability ball 1, a variable number of rib assemblies 10 may be used to form the device 2. The greater the number of rib assemblies used, the greater amount of resistance will be provided to the ball's movements.

In this particular embodiment, the central base 11 of the device 2 is formed at the point where the rib assemblies 10 overlap and cross one another. The ribs 3 radiate from this central base 11 in a radial pattern that resembles the flower head of a daisy. When placed on a substantially flat surface, the central base 11 of device 2 provides a base, or resting position for the stability ball 1 when the ball is present.

Figure 30:
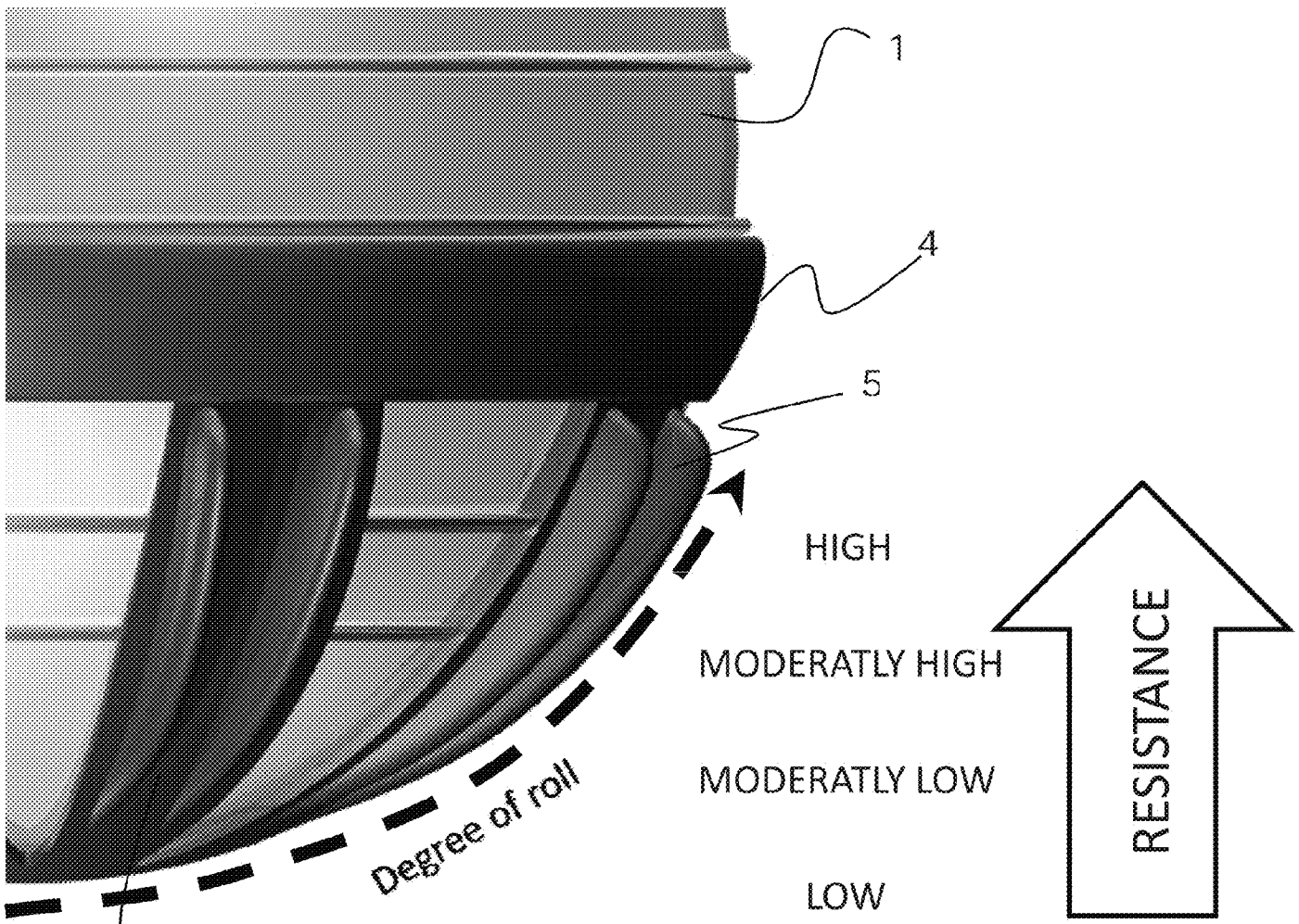
FIG. 30 is a pictorial representation of the relationship between the degree of rotation of the stability ball, when used in conjunction with the inclined planes or wings of the exercise device of the present invention, and the resistance felt by the user.
Figure 31:
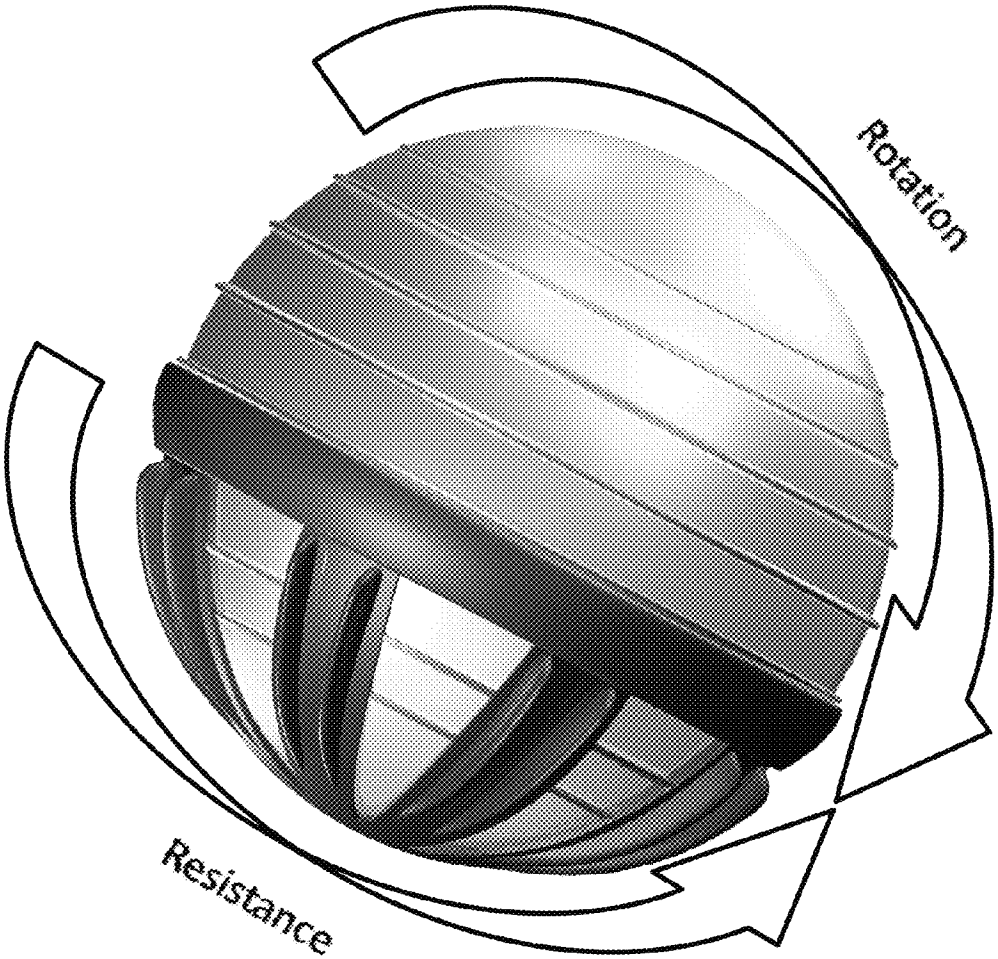
FIG. 31 is another pictorial representation of the relationship between the degree of rotation of the stability ball, when used in conjunction with the inclined planes or wings of the exercise device of the present invention, and the resistance felt by the user.

Incorporated into the exterior surface of each rib 3 is a pair 9 of inclined planes or "wings" 5 that extend substantially parallel to a longitudinal axis of the rib and protrude perpendicularly from the exterior surface of the rib. Each inclined plane or wing 5 steadily increases in its protruding distance, or angle of inclination, as it approaches the radiating or anchoring end 8 of the rib 3 at the belt 4 of the device 2. The addition of these inclined planes or wings 5 to the ribs 3 of the inventive device 2 provides an incremental amount of resistance to the rolling movement of the stability ball 1, thereby requiring a greater muscular effort to move the ball as it rolls further from its base position (i.e., the upright, established position of the ball when it is at rest). FIGS. 30 and 31 graphically illustrate the counteractive or balancing relationship between the degree of the rolling movement of the ball from its base position and the amount of resistance created by the inclined planes or wings 5 of the ribs 3. During exercise movements, the stability ball 1 is naturally inclined to roll away from its base (i.e., resting) position, which is desirable for the user when controllable and stable. With the addition of the inventive device 2, as the ball rolls away from its base position in any direction along a substantially flat surface, the inclined planes or wings 5 of the ribs 3 come into contact with the substantially flat surface to provide an increasing, counteracting or balancing resistance to movement of the ball away from its base position in an incremental fashion. In other words, the greater the degree of rollaway motion of the ball from its base position, the greater amount of surface area of the inclined planes or wings 5 come into obstructive contact with the substantially flat surface thereby providing an increased amount of resistance to the ball's movement. The resistance created by the inclined planes or wings 5 of the ribs 3 drives the ball back towards its original, base position. Thus, as the user's exercise movements cause a rotation of the ball in one direction, the ribs increase the resistance in the other direction, which stabilizes the ball's inherent and uncontrolled movements and increases the effectiveness of the exercise. Inventively, the exercise device 2 of the present invention stabilizes the ball while still allowing it to perform its function and with increased resistance experienced by the user.

Referring back to FIGS. 1-6, in this particular embodiment, the belt 4 of the device 2 has intermittent curves 6 along its length between the points at which the rib assemblies 10 are removably anchored or secured to the belt 4. In this way, the anchoring or securing points are clearly set apart so that they are easily identifiable by the user and the resulting spatial footprint of the device 2 on the ball 1 is reduced.

The belt 4 and the rib assemblies 10 may be comprised of, but not limited to, heavy-duty nylon. However, other materials including high-impact plastic are feasible.

Additionally, the device 2 may incorporate a supplementary elastic band exercise system (not shown), which allows the user to attach elastic bands to the device thereby adding a resistance-training component to the device.

Figure 12:
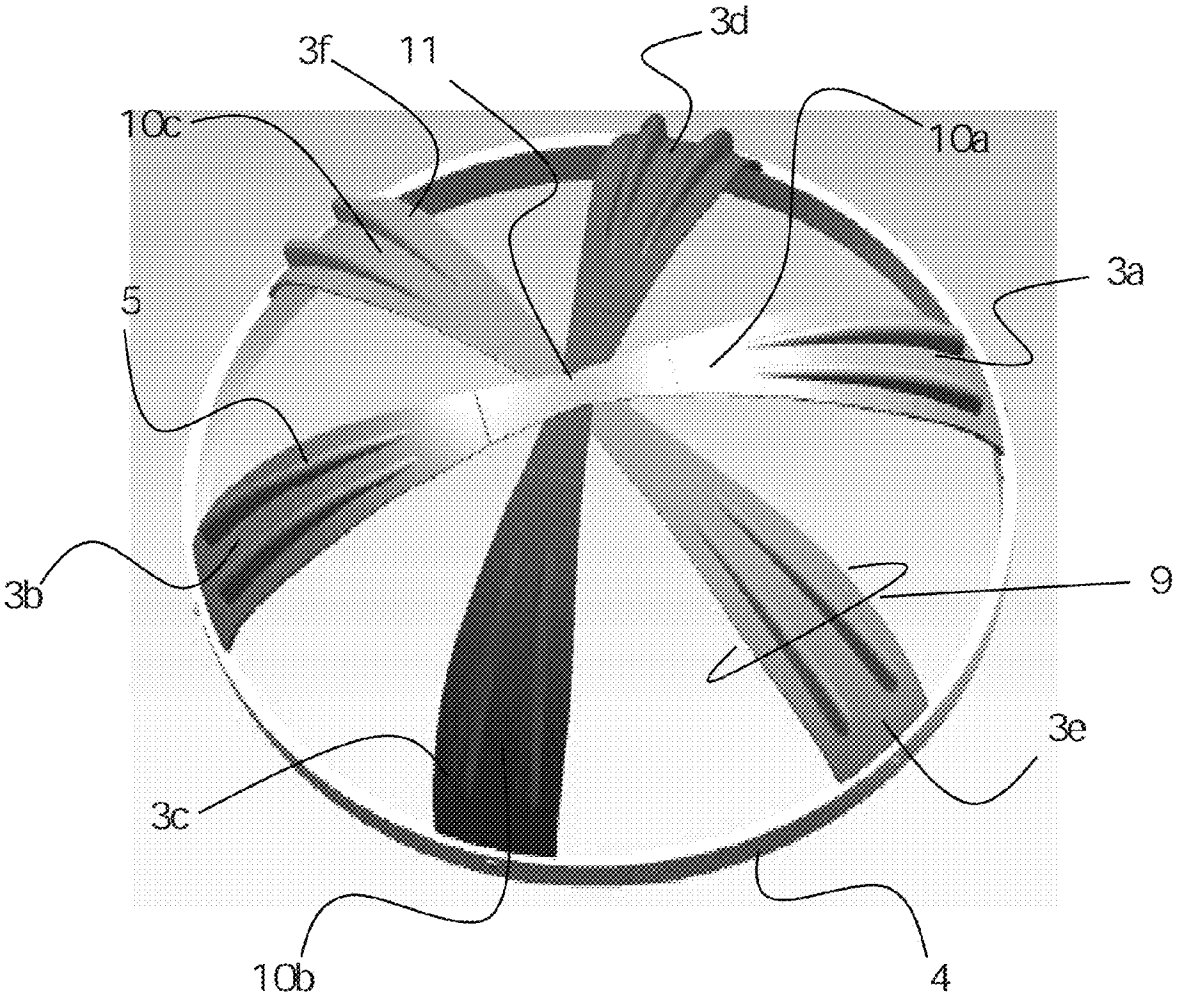
FIG. 12 is a view of the bottom of the exercise device of FIG. 7, having three separate rib assemblies.
Figure 14:
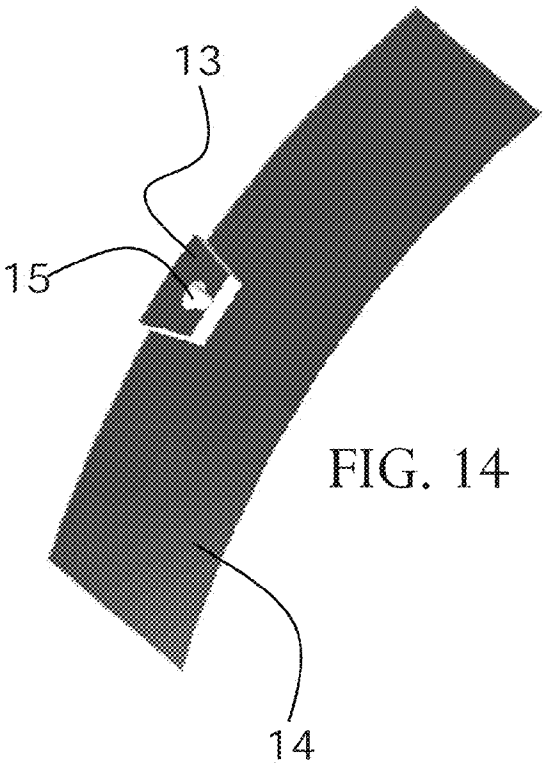
FIG. 14 shows the detail of the trapezoidal indentation on the inner surface of the belt shown in FIG. 13.
Figure 13:
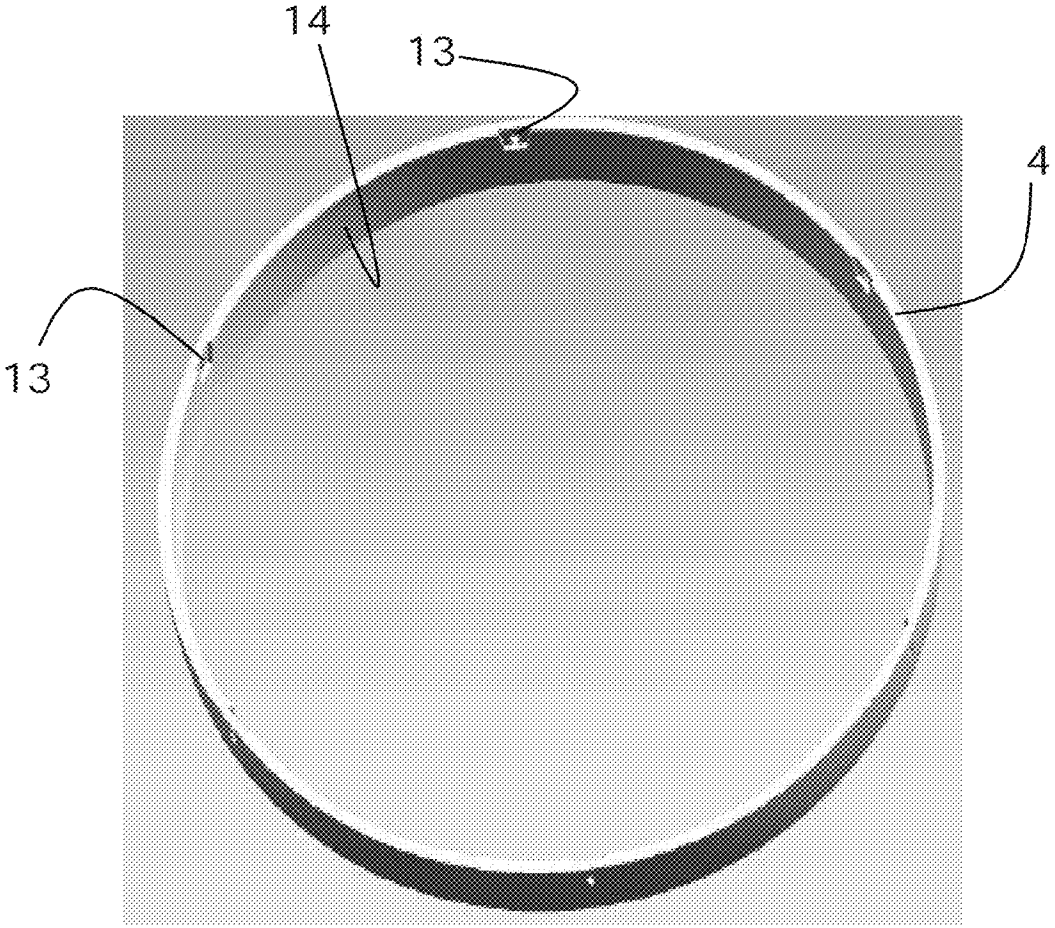
FIG. 13 is a perspective view of the belt of the exercise device of FIG. 7 that surrounds the stability ball and acts as the anchoring point for the ribs whereby the anchoring points are indicated by trapezoidal indentations.

In FIGS. 7-17, there is shown a second exemplary embodiment of the exercise device 2 according to the present invention. Similarly to the exemplary embodiment depicted in FIGS. 1-6, the exercise device 2 is comprised of a belt 4 that is shaped to tightly surround the circumference of a stability ball 1 just below the ball's midline, and four (as shown in FIGS. 7-11) or three (as shown in FIGS. 12 and 13) rib assemblies 10*a*, 10*b*, and 10*c*, flexibly bent into semicircular arcs that are removably, and equidistantly, secured or held in a register to the belt 4 at indentations or notches 13 of the interior surface 14 of the belt 4 (which are shown in detail in FIGS. 13 and 14). Together, the rib assemblies 10*a-c* and the belt 4 form a radially-shaped "cage" or "enclosure" of the lower half of the ball 1. However, in this particular embodiment, the belt 4 does not have intermittent curves along its length and instead, the belt 4 has a constant width 12 along its entire length. As clearly shown in FIGS. 11 and 12, the rib assemblies 10*a-c* come together centrally to form a central base 11, which when placed on a substantially flat surface, provides a base, or resting position for the stability ball 1 when the ball is seated inside the device 2.

Figures 15, 16, 17:
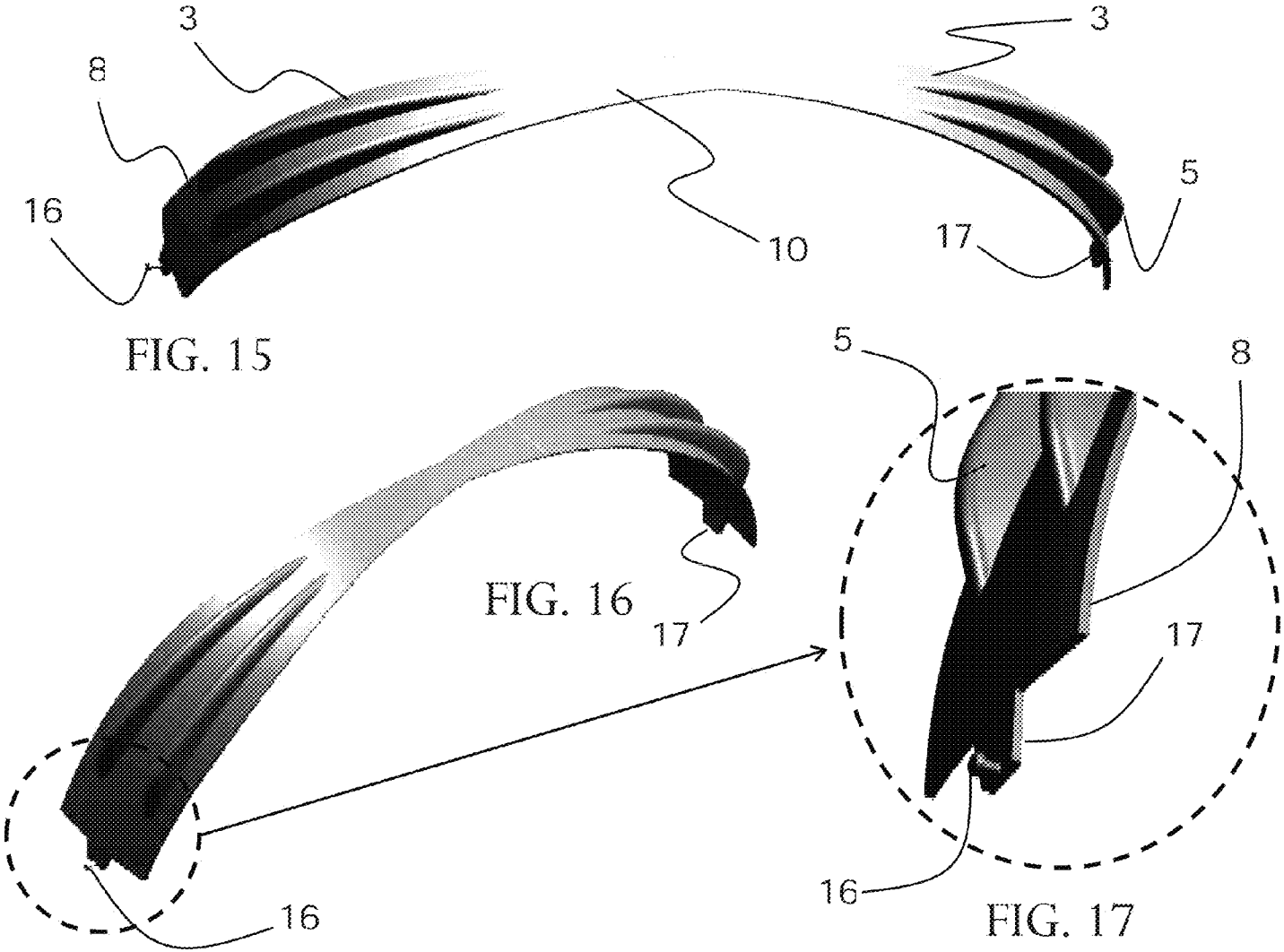
FIG. 15 is a top perspective view of one of the rib assemblies of FIG. 12 showing a pair of inclined planes or wings and end clips that attach to the belt.
FIG. 16 is a perspective view of the rib assembly of FIG. 15.
FIG. 17 shows, in close-up detail, a trapezoidal extension and link pin found at the end clip of the rib assembly of FIGS. 15 and 16, whereby the link pin is accommodated by the keyhole slot of the trapezoidal indentation of the belt shown in FIG. 14.

FIGS. 15-17 show, in close detail, any one of the rib assemblies 10*a-c* of FIG. 12. Each rib assembly defines two ribs, 3*a-b*, 3*c-d*, and 3*e-f* that radiate from the central base 11 in a wheel-and-spokes pattern whereby the ribs increasingly widen in a direction away from the central base 11. Each rib has a pair 9 of raised, inclined planes 5 that run substantially parallel along the rib's longitudinal axis. At each radiating end 8 of the rib assembly, there lies a trapezoidal protrusion 17 and a linking pin 16 for securing the rib assembly to the belt 4. To secure each end 8 of the rib assemblies 10*a-c* to the belt 4, a corresponding number of trapezoidal indentations or notches 13, having keyhole slots 15, are formed in the interior surface 14 of the belt 4 (see FIGS. 13 and 14). The trapezoidal indentations or notches 13 are shaped to have a corresponding, or mating fit to the trapezoidal protrusions 17 of the rib assembly and each keyhole slot 15 of the trapezoidal indentations or notches is shaped to retain the linking pin 16 of the rib assembly. By mating both the trapezoidal indentations or notches 13 of the belt with the trapezoidal protrusions 17 of the rib assembly, and the keyhole slots 15 of the belt with the linking pins 16 of the rib assembly, the rib assembly is removably secured to the belt.

Figures 25, 26, 27, 28, 29:
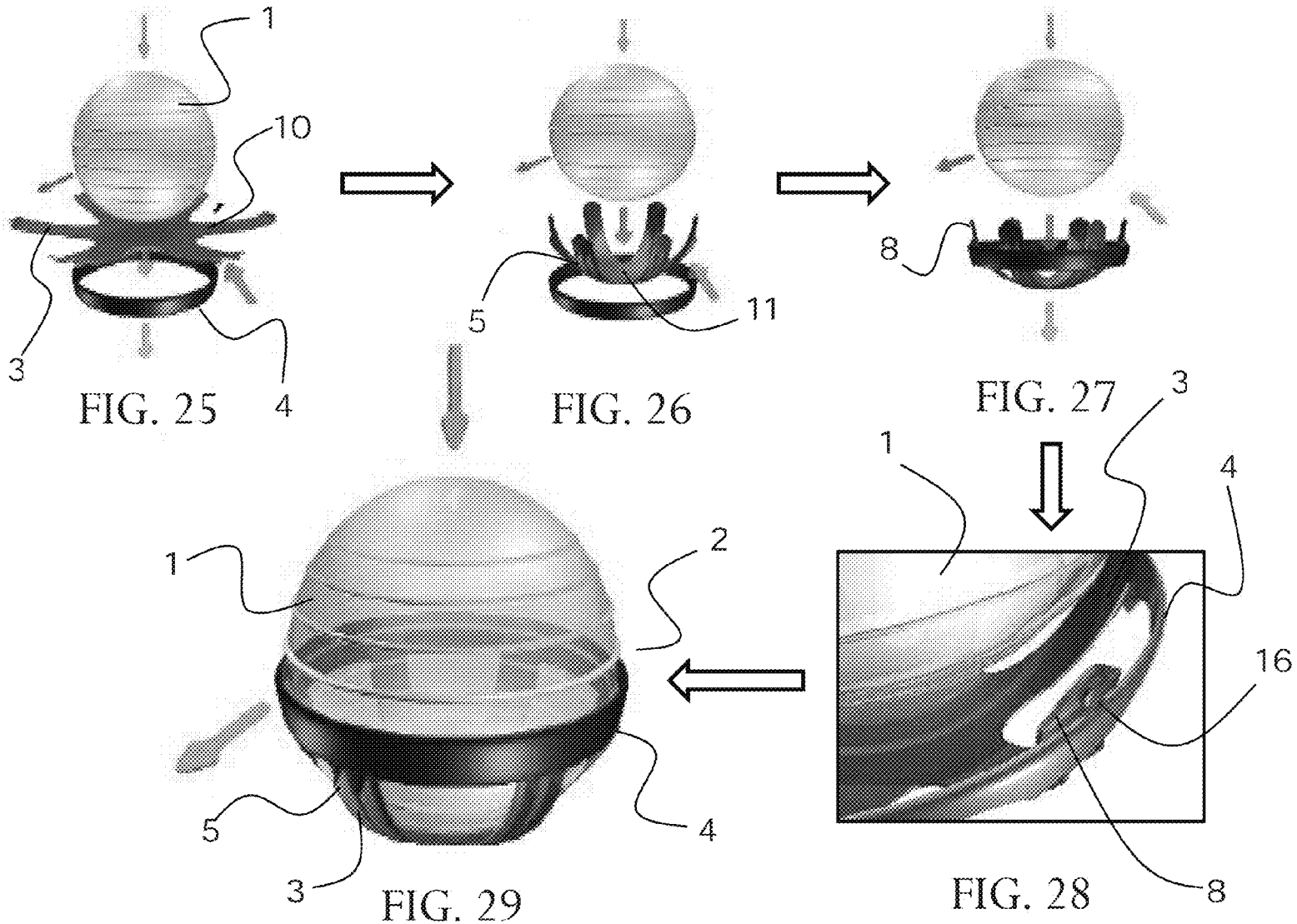
FIGS. 25-28 illustrate the steps of assembling the exercise device of FIG. 7 and applying the device to a stability ball according to an exemplary embodiment of the present invention.
FIG. 29 shows the exercise device of FIG. 7 in a fully assembled configuration following the steps shown in FIGS. 25-28.

To illustrate the sequential steps for assembling the exercise device 2 of FIGS. 7-17, and applying the exercise device 2 to a stability ball 1 in accordance with one exemplary embodiment of the present invention, FIGS. 25-29 provide a pictorial representation of the assembly-line process. In the first step, as shown in FIG. 25, the rib assemblies 10 are placed between the stability ball 1 and the belt 4 in a substantially flat, radial configuration with the ribbed surface of the rib assemblies facing downwards towards the belt. In the second and third steps, as shown in FIGS. 26 and 27, in a fluid motion using the belt, the rib assemblies 10 are guided upwards into their semicircular arc or bow shape as permitted by the inherent flexibility of the material comprising the rib assemblies 10. As a result, the rib assemblies form a concave-shaped seat, having a central base 11, in which the ball 1 is seated. In the next step, as shown in FIG. 28, the ribs 3 of each rib assembly 10 are removably secured to the belt 4 at their ends 8 by sliding the linking pin 16 into the corresponding keyhole slot 15 (not shown) formed in the interior surface of the belt. Once the rib assemblies are removably secured or anchored to the belt, the resulting device 2, as shown in FIG. 29, tightly captures and encloses the lower portion of the ball 1.

Figure 18:
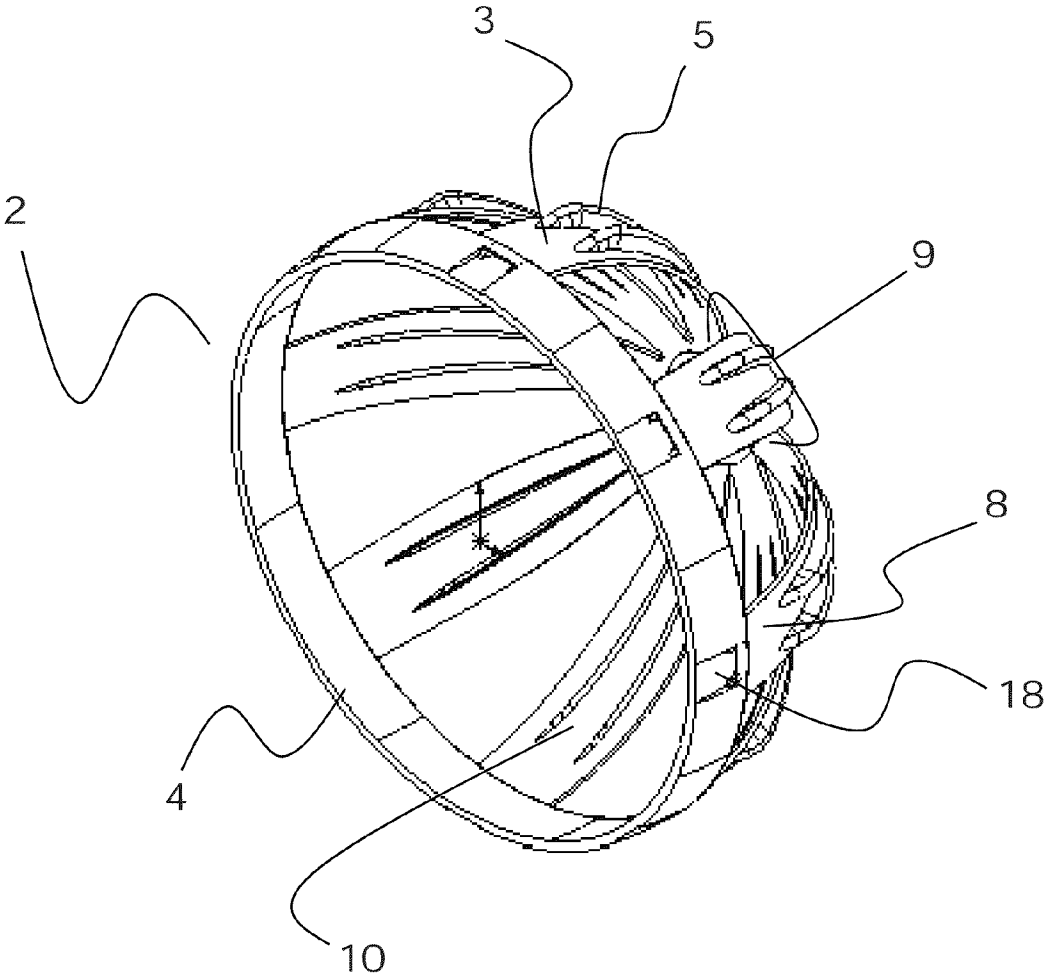
FIG. 18 is an elevational perspective view of a third exemplary embodiment of the exercise device according to the present invention in a fully assembled configuration and as it appears when not applied to a stability ball.
Figure 20:
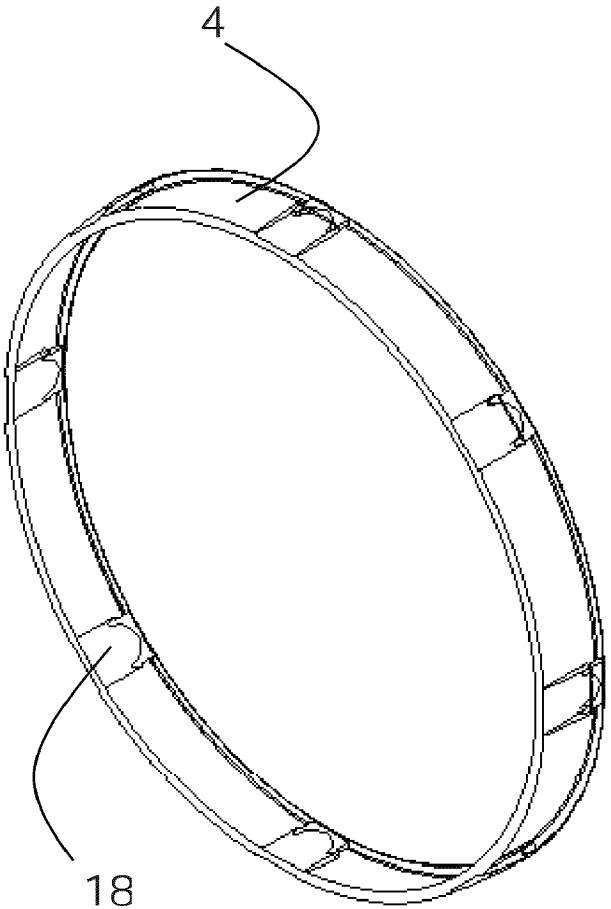
FIG. 20 is an elevational perspective view of the belt of the exercise device of FIG. 18.
Figure 19:
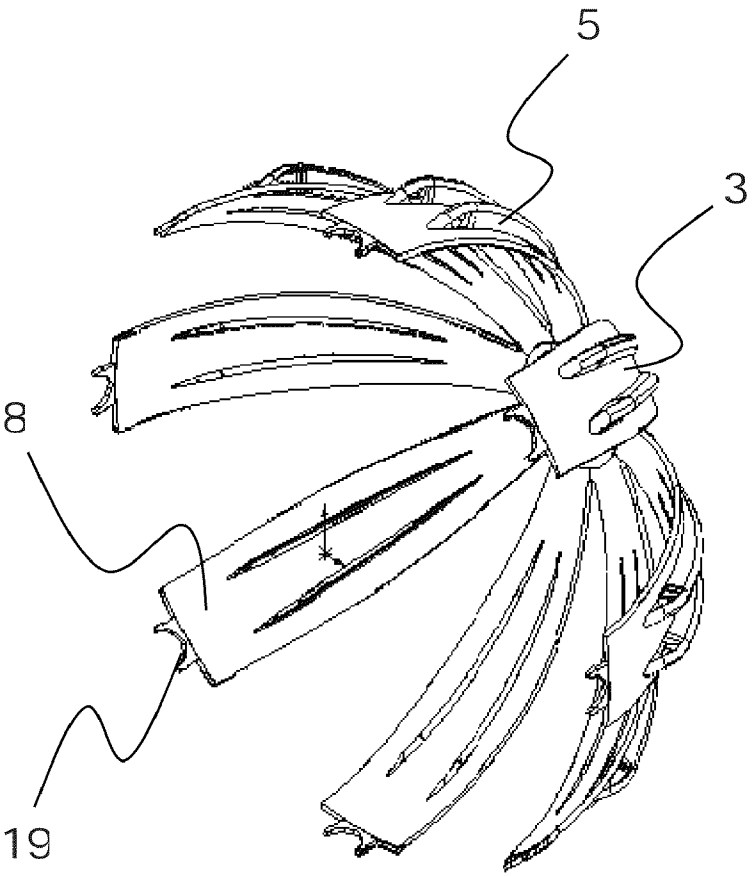
FIG. 19 is an elevational perspective view of the exercise device of FIG. 18, without the belt attached.

The mechanism described above for anchoring or securing the rib assemblies to the belt serves as just one illustration of a large number of mechanisms that are contemplated by the present invention. For example, FIGS. 18-20 illustrate a third exemplary embodiment of the exercise device 2 according to the present invention that is very similar to the embodiments of FIGS. 1-17 except for the securing mechanism between the ends 8 of the rib assemblies 10 and the belt 4. As shown in detail in FIG. 19, each rib 3 has a U-shaped hook or protrusion 19 at its radiating end 8. As depicted clearly in FIG. 20, to secure the rib 3 to the belt 4, the belt has a corresponding number of U-shaped slots or notches 18 along the length of the belt's circumference that are shaped to matingly fit the U-shaped hooks or protrusions 19 of the ribs 3 when the U-shaped hooks or protrusions 19 are slidingly inserted into the slots 18 of the belt in a buckle-like fashion.

Figure 22:
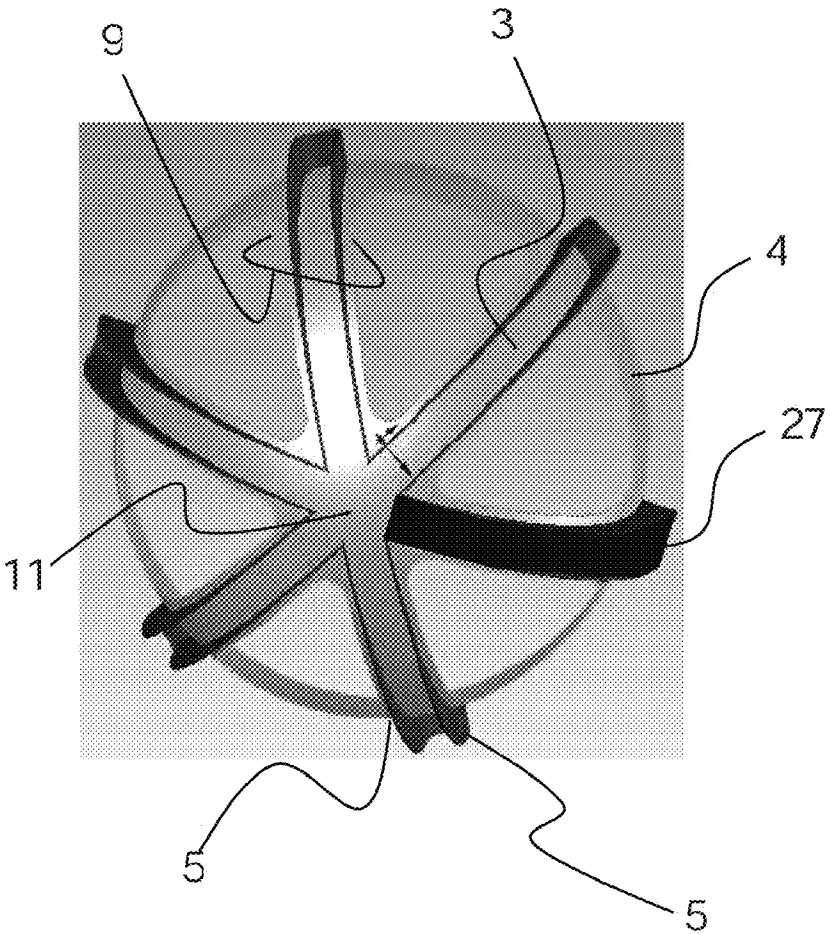
FIG. 22 is a bottom view of the exercise device of FIG. 21 with an alternative embodiment of inclination on one of the ribs.
Figure 21:
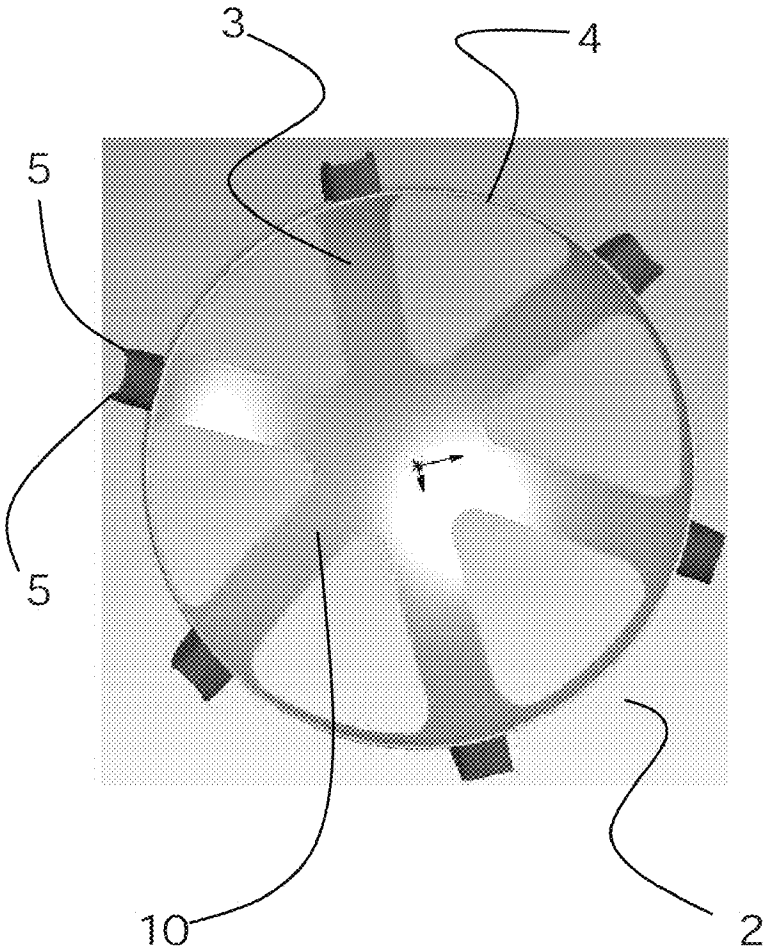
FIG. 21 is a top view of a fourth exemplary embodiment of the exercise device according to the present invention in a fully assembled configuration and as it appears when not applied to a stability ball.
Figure 24:
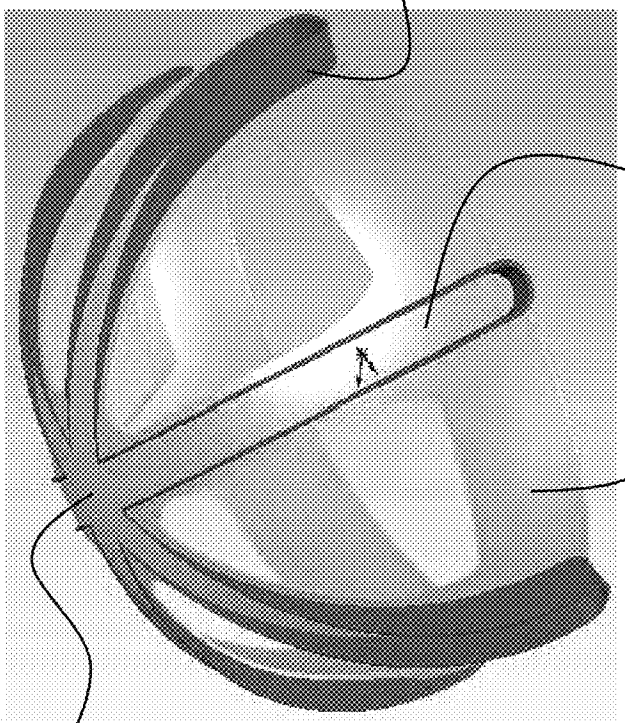
FIG. 24 is a perspective view of the right side of the exercise device of FIG. 21.
Figure 23:
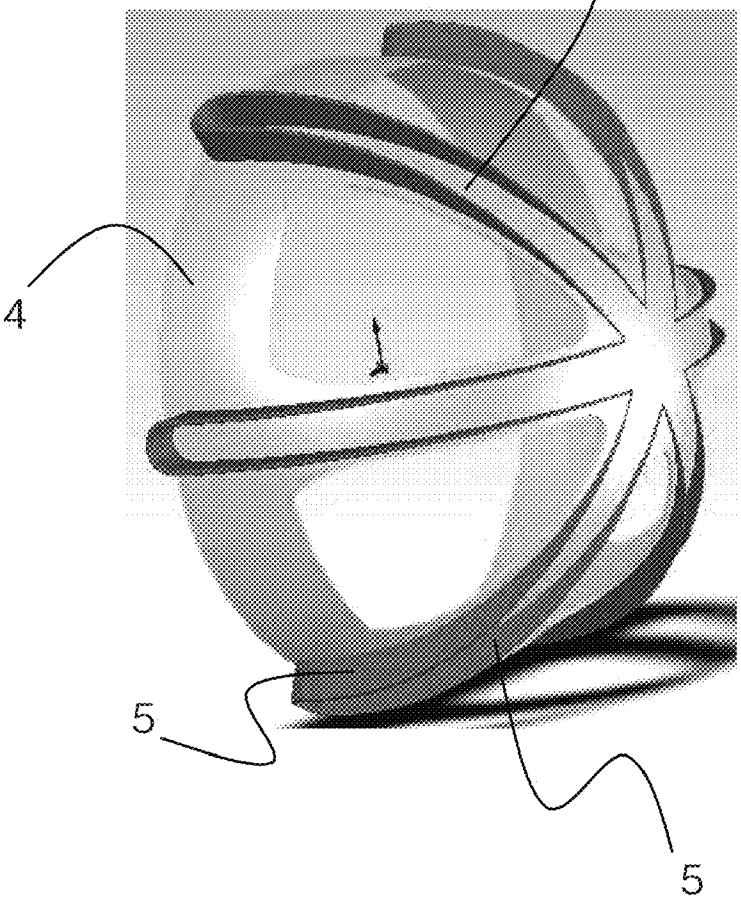
FIG. 23 is a perspective view of the left side of the exercise device of FIG. 21.

Alternatively, it is contemplated by the present invention that any mechanism for anchoring or securing the rib assemblies 10 to the belt 4 may be entirely omitted. For example, FIGS. 21-24 illustrate a fourth exemplary embodiment of the exercise device 2 according to the present invention whereby the rib assemblies 10 and the belt 4 are formed as a single integral piece such that the rib assemblies cannot be removed, but are permanently secured to the belt. This type of assembly for the exercise device 2 may be made by, for example, injection-type molding. FIG. 22 illustrates on one rib 3, an alternative embodiment of the inclined planes or wings 5 is shown as a single inclined wedge or wing 27. Thus, it should be noted that a number of alternative shapes and a variable number of the inclined planes or wings 5 are possible with the invention and include, for example, a single inclined plane 5 or a variable number of inclined planes 5 for any one or more of the ribs 3.

Figure 32:
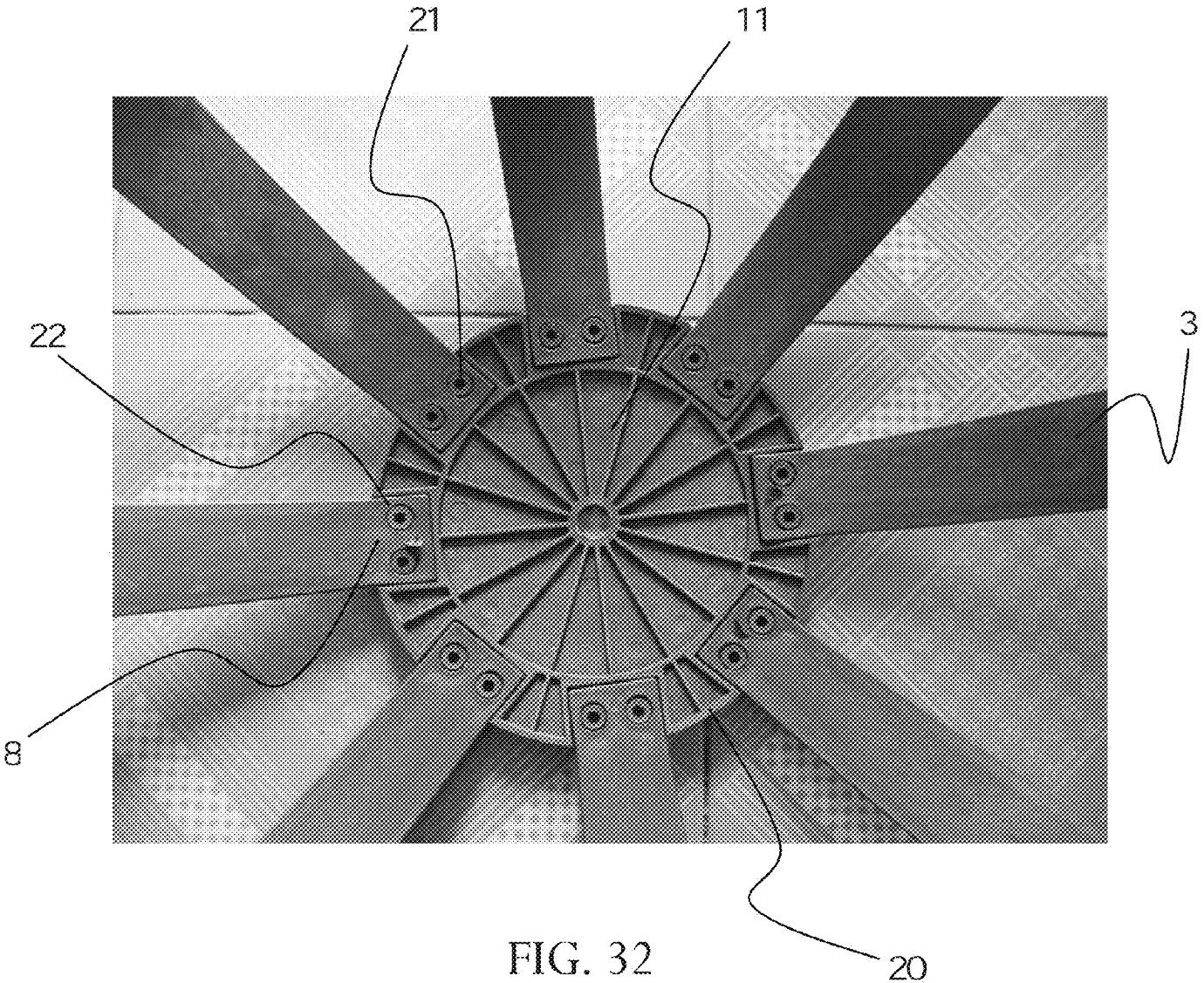
FIG. 32 is a partial, top view of the interior of a fifth exemplary embodiment of the exercise device according to the present invention whereby, shown in detail, are the ribs anchored also at a central hub forming the bottom of the device.
Figure 33:
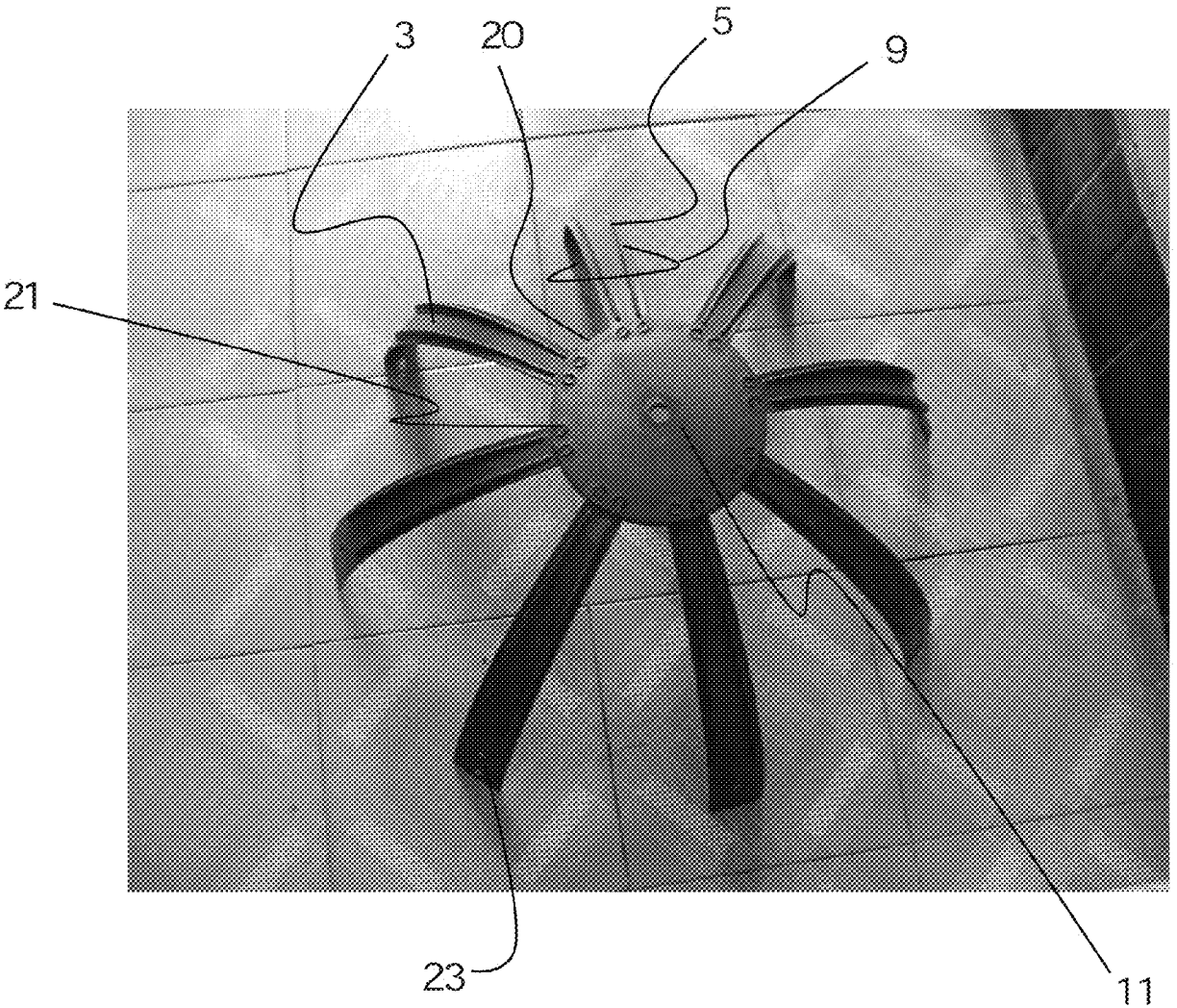
FIG. 33 is a bottom view of the exterior of the exercise device of FIG. 32, without the belt attached.
Figure 34:
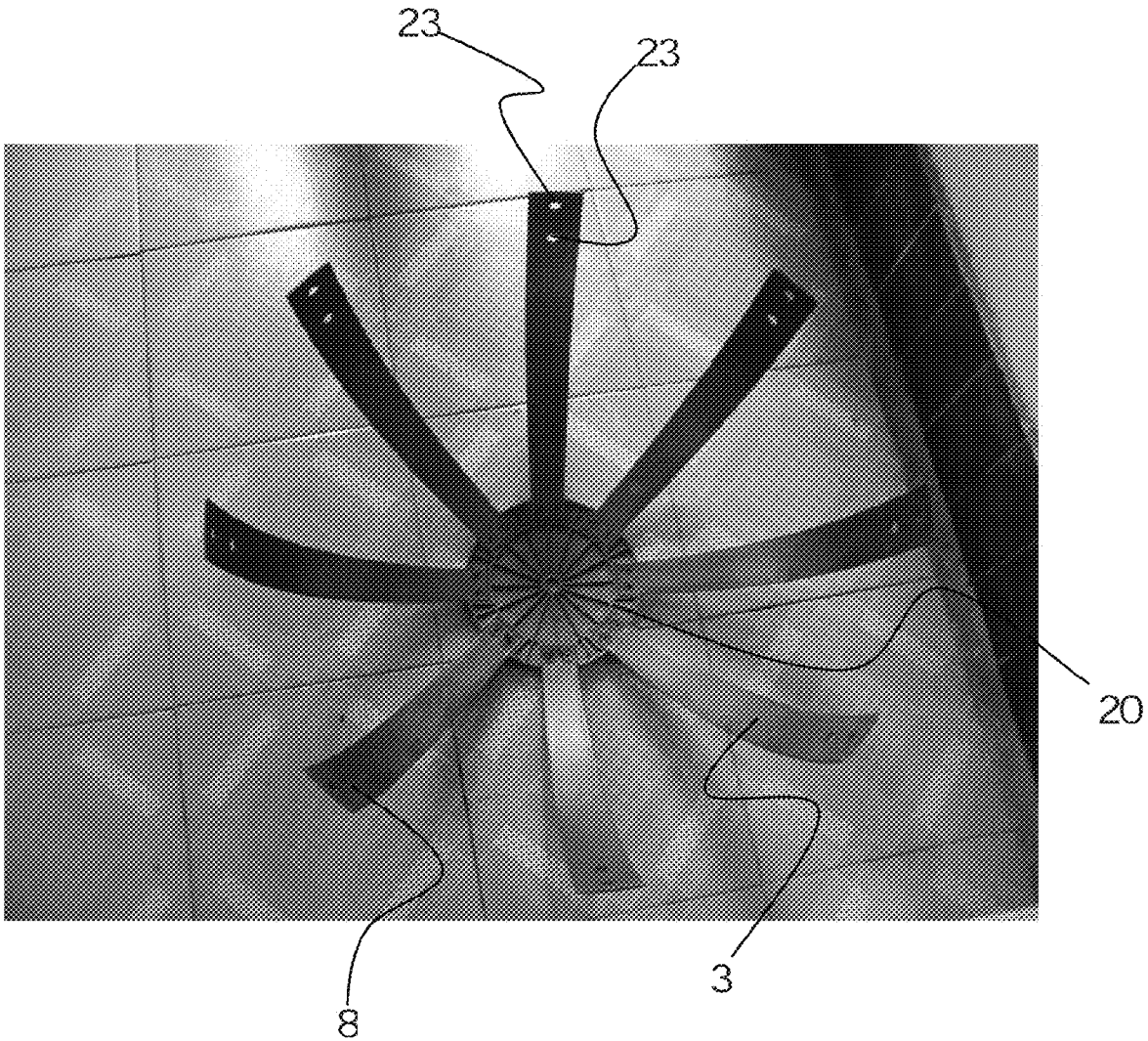
FIG. 34 is a top view of the interior of the exercise device of FIG. 32, without the belt attached.
Figure 35:
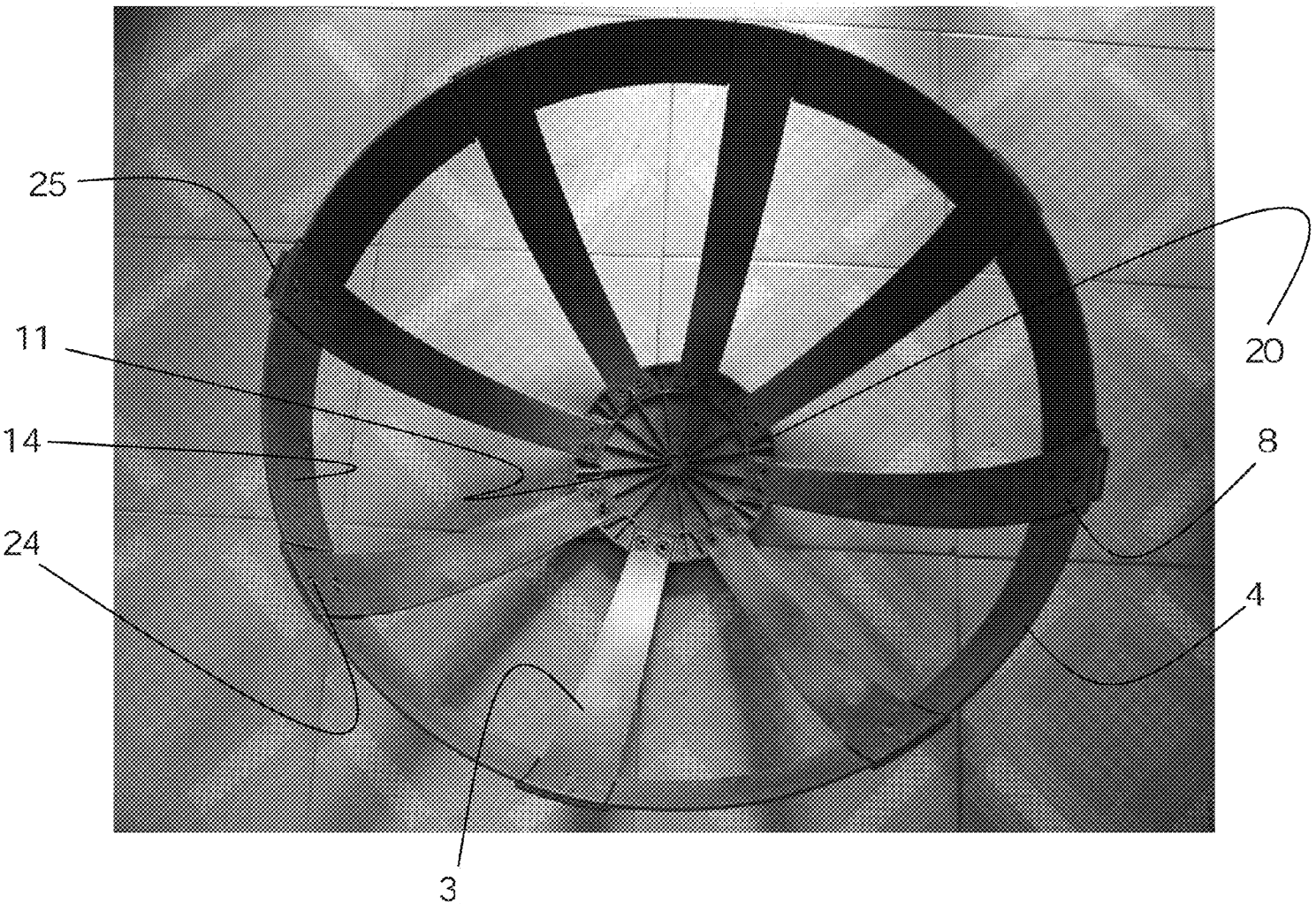
FIG. 35 is a top view of the interior of the exercise device of FIG. 32, in a fully assembled configuration with the belt attached.
Figure 36:
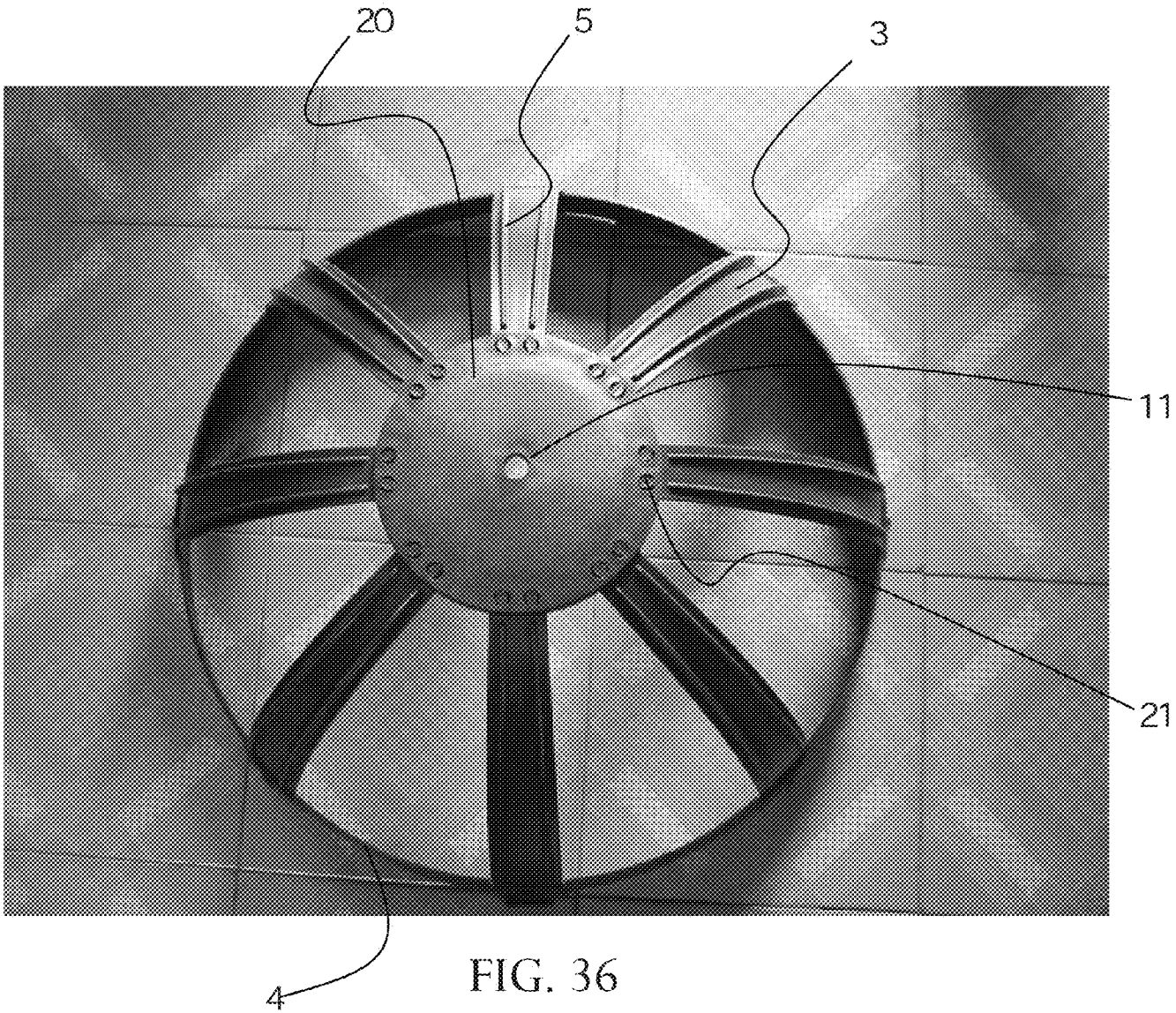
FIG. 36 is a bottom view of the exterior of the exercise device of FIG. 32, in a fully assembled condition with the belt attached.
Figure 37:
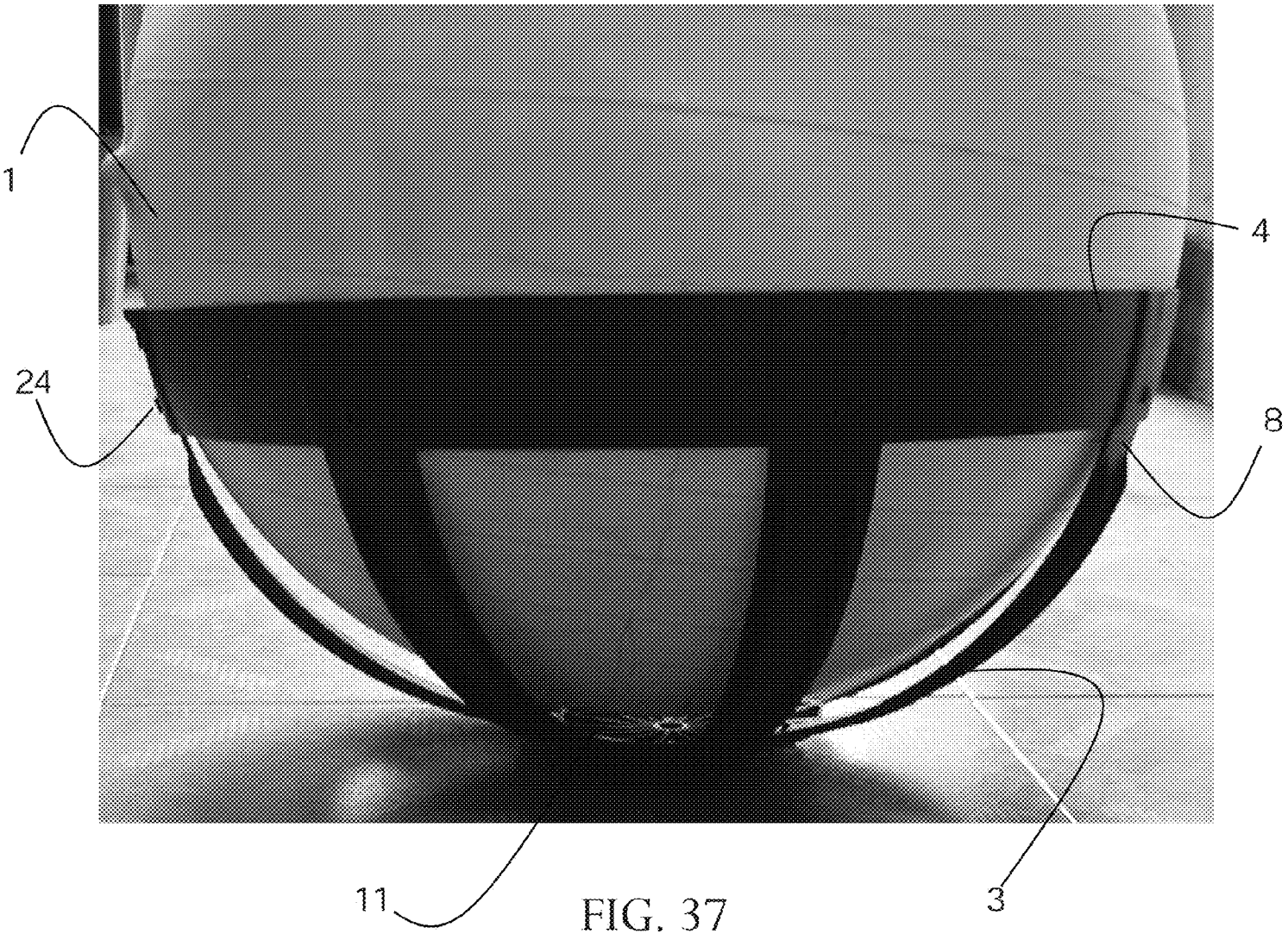
FIG. 37 is a side view of the exercise device of FIG. 32 after its application to a stability ball.
Figure 38:
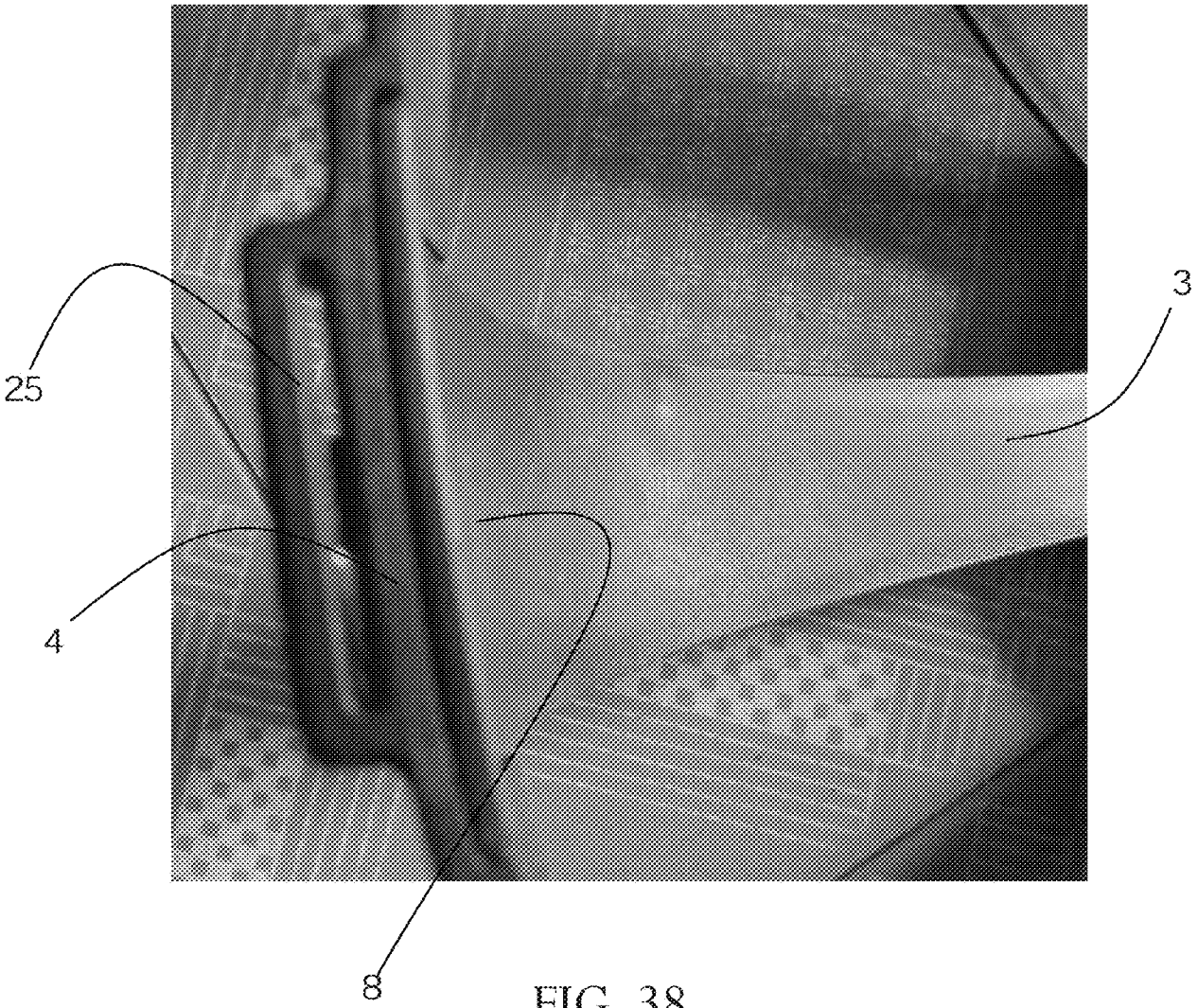
FIG. 38 shows, in close-up detail, a single rib of the exercise device of FIG. 32 at its anchoring point to the belt.
Figure 39:
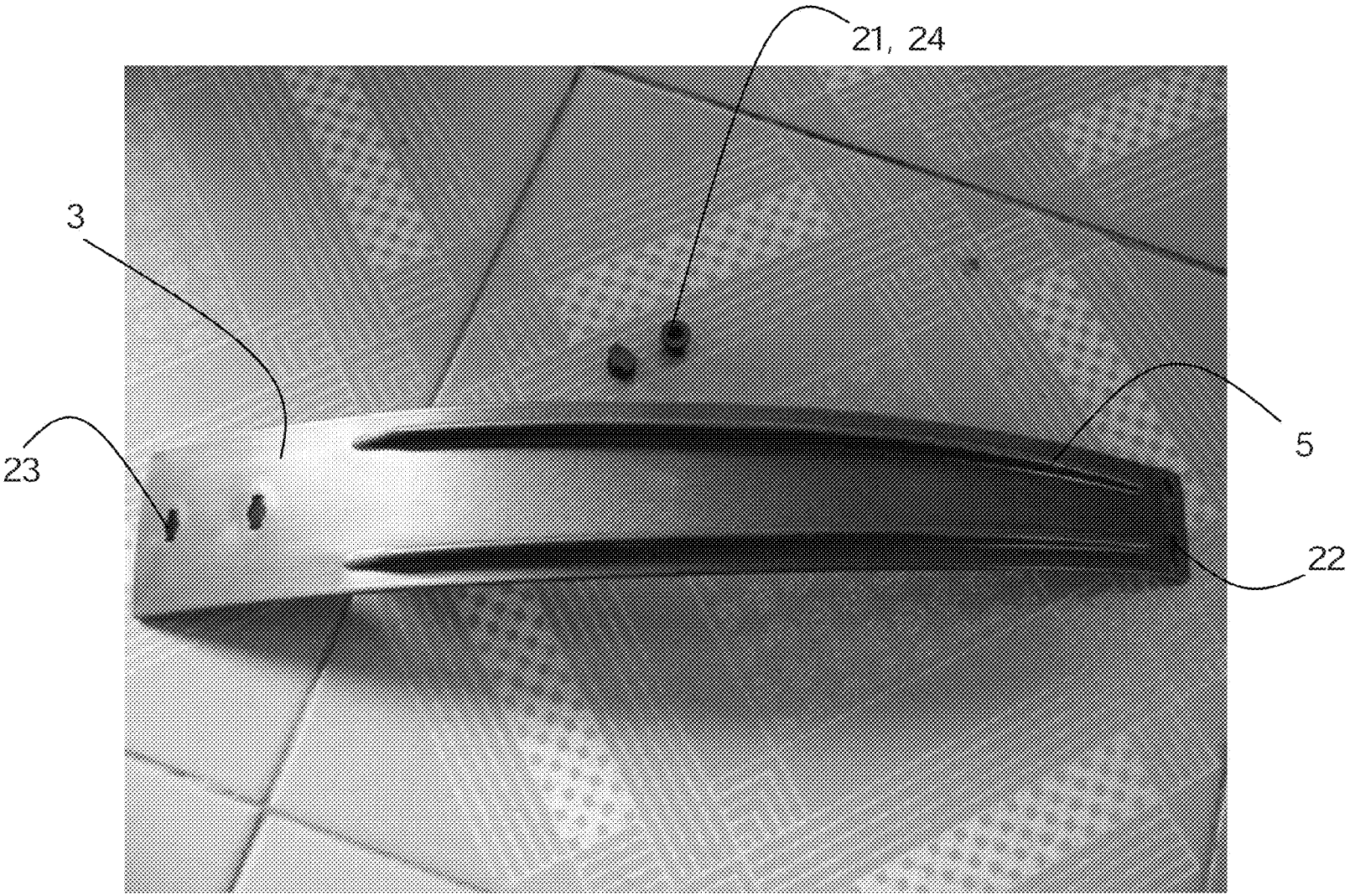
FIG. 39 is an exterior view of a single rib of the exercise device of FIG. 32 having a pair of inclined planes and two mounting holes at each end for anchoring the rib to the central hub and the belt.
Figure 40:
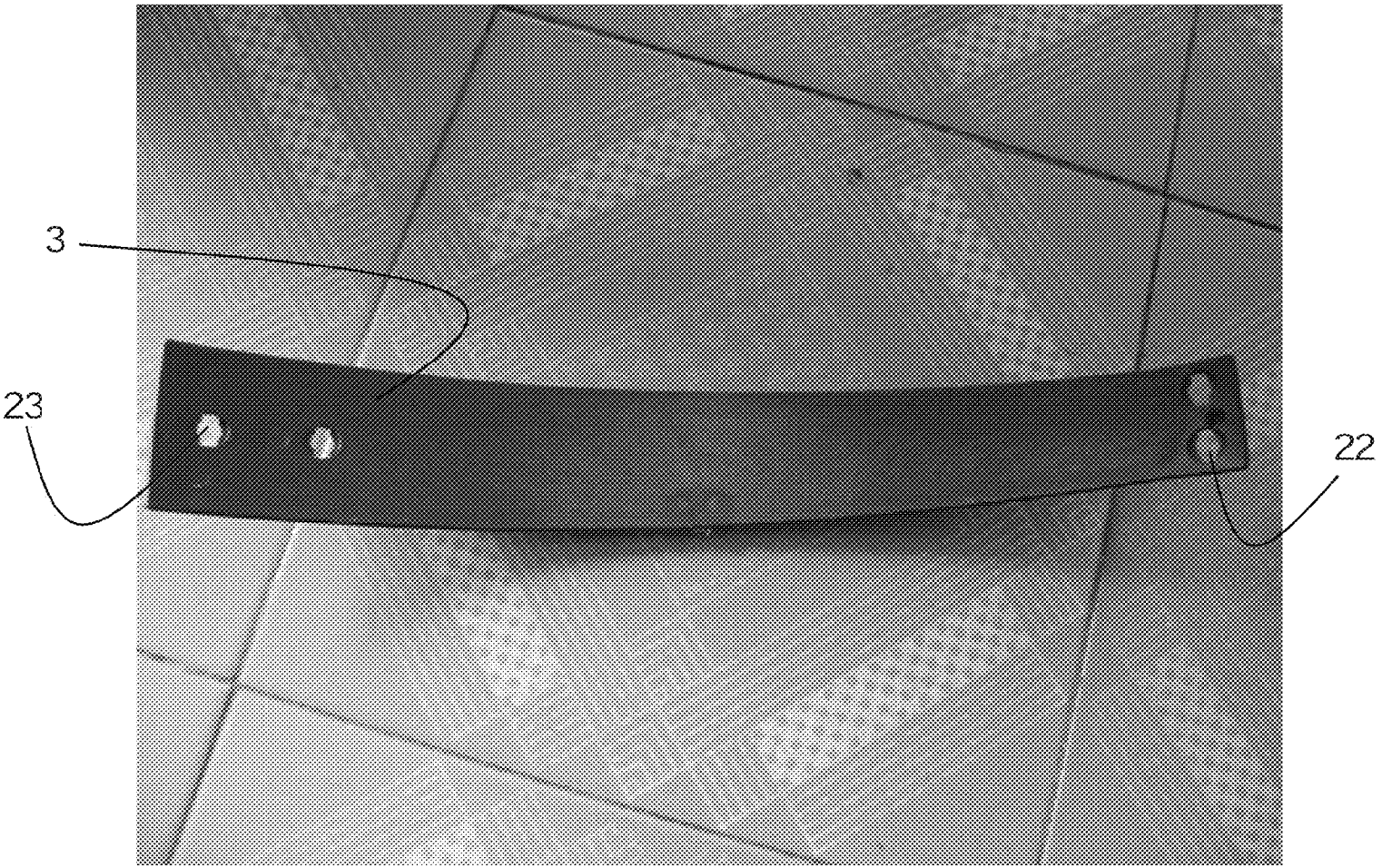
FIG. 40 is an interior view of a single rib of the exercise device of FIG. 32.
Figure 41:
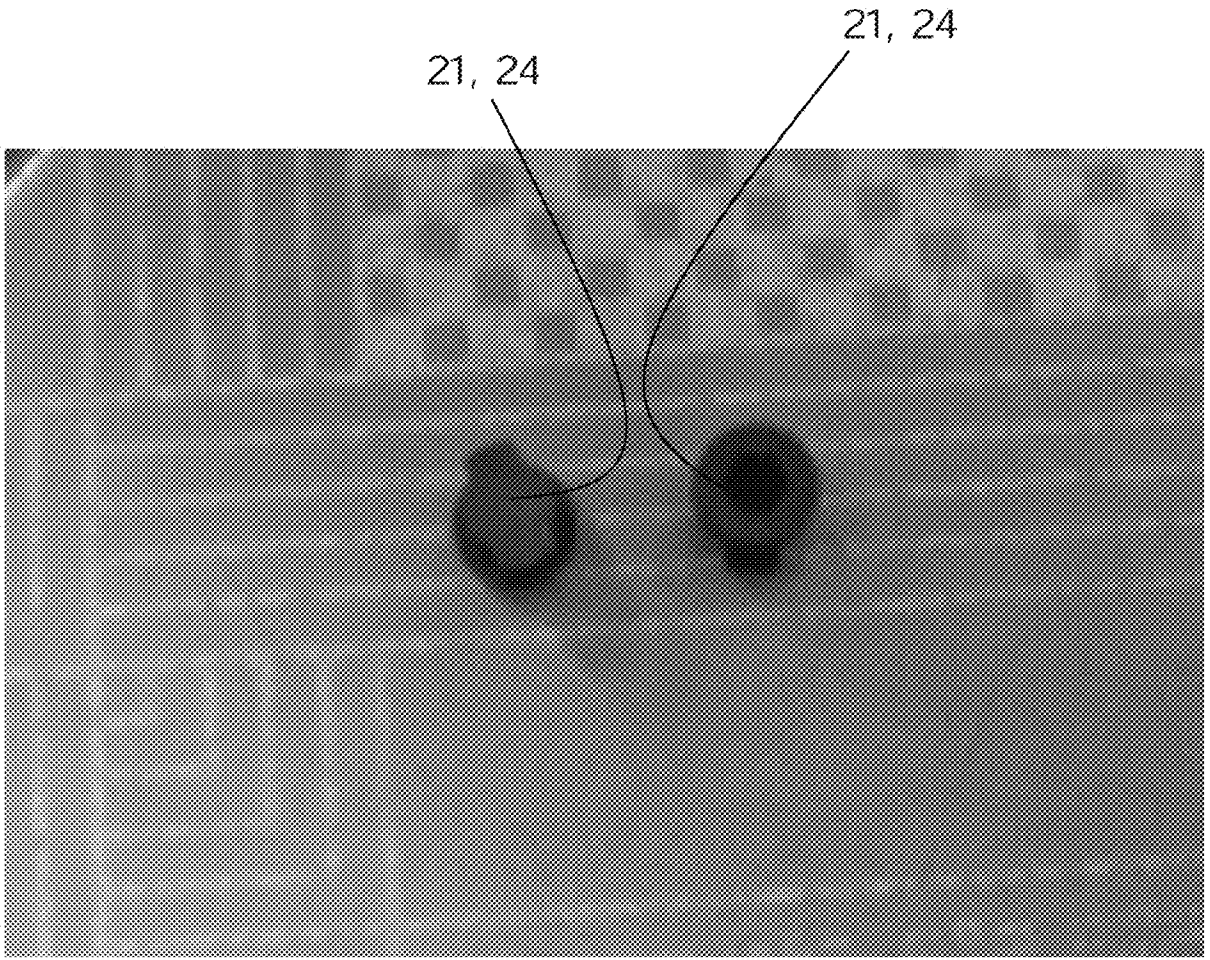
FIG. 41 shows two locking pins for anchoring the ribs of the exercise device of FIG. 32 to the central hub and the belt, whereby the locking pins are accommodated by the mounting holes of the ribs and corresponding mounting holes of the central hub and belt.

In FIGS. 32-40, there is shown a fifth exemplary embodiment of the exercise device 2 according to the present invention, which differs from the previously described embodiments in that the plurality of rib assemblies 10 are cut in half into their constituent ribs 3, and a central hub 20 is used to interconnect the ribs 3 at the ends 8 of the ribs that are proximate the central base 11. By dividing the rib assemblies into their constituent ribs 3 and incorporating the central hub 20, the central base 11 of the device 2 is no longer formed by the overlapping rib assemblies 10, and thereby provides a smooth rolling surface. Instead, both ends 8 of the ribs 3 are now removably secured to either the belt 4 or the central hub 20. For example, as shown in close detail in FIGS. 39 and 40, the narrower end 8 of the rib 3 that is proximate to the central hub 20 when assembled, has two adjacent, vertically-aligned mounting holes 22. At the wider end 8 of the rib 3 that is proximate to the belt 4 when assembled, there are two adjacent, horizontally-aligned mounting holes 23. As best shown in FIGS. 32 and 36, to secure the ribs 3 to the central hub 20, two locking pins 21 (shown in detail in FIG. 41) are inserted into mounting holes 22 and through corresponding, recessed holes along the outer circumference of the central hub 20 to securely attach the two pieces together. The locking pin may be of any suitable type, such as an Allen-type pin. Similarly, as best shown in FIG. 35, to secure the ribs 3 to the belt 4, two locking pins 24 are inserted into mounting holes 23 and through corresponding, recessed holes along the circumferential length of the belt 4 from the interior surface or side 14 of the belt. The resulting device 2, in a fully assembled configuration, is shown in FIG. 37. Brackets 25 are molded onto the belt 4 at two points on the circumference of the exercise device that are 180 degrees apart. These brackets 25 are used to attach resistance tubes to the device, for example, using nylon belts with D-rings so that resistance-training exercises can be performed on the ball.

The foregoing description and accompanying drawings illustrate the principles, preferred embodiments and modes of operation of the invention. However, the invention should not be construed as being limited to the particular embodiments discussed above. Additional variations of the embodiments discussed above will be appreciated by those skilled in the art and the above-described embodiments should be regarded as illustrative rather than restrictive. Accordingly, it should be appreciated that variations to those embodiments can be made by those skilled in the art without departing from the scope of the invention as defined by the following claims.

The above-described embodiments should be regarded as illustrative rather than restrictive. Accordingly, it should be appreciated that variations to those embodiments can be made by those skilled in the art without departing from the scope of the invention as defined by the following claims.

What is claimed is:

1. An exercise device, comprising:

a body having:

rib-like structures, each:

having an exterior surface defining a longitudinal extent;

terminating at a radiating end; and having at least one wing formed substantially parallel to the longitudinal extent and protruding away from the exterior surface to a given distance that increases along a direction towards the radiating end, the rib-like structures overlapping at a central point to comprise a central base; and an annular band connected to the radiating end of each rib-like structure such that the rib-like structures and the band together form a cup-shaped enclosure operable to seat therein a bottom portion of an exercise ball, the at least one wing of each rib-like structure operable to provide an incremental resistance against a rolling movement of the exercise ball along a substantially flat surface when the exercise ball is seated therein.

2. The exercise device according to claim 1, wherein the at least one wing is operable to come into rolling contact with the substantially flat surface as the exercise ball is rolled in a direction along the substantially flat surface thereby biasing the exercise ball in a direction opposing the rolling direction of the exercise ball.

3. The exercise device according to claim 1, wherein the diameter of each rib-like structure widens towards the radiating end of the rib-like structure.

4. The exercise device according to claim 1, wherein the annular band is removably secured to the radiating end of each rib-like structure.

5. An exercise device, comprising:
a body having:
an annular hub;
rib-like structures radiating from the hub, each rib-like structure:
having an exterior surface defining a longitudinal extent;
terminating at a distal radiating end; and
having at least one wing formed substantially parallel to the longitudinal extent and protruding away from the exterior surface to a given distance that increases along a direction towards the radiating end; and
an annular band connected to the radiating end of each rib-like structure such that the annular hub, the rib-like structures, and the band together form an enclosure operable to surround a bottom portion of an exercise ball seated therein, the at least one wing of each rib-like structure operable to provide an incremental resistance against a rolling movement of the exercise ball along a substantially flat surface when the exercise ball is seated therein.

6. The exercise device according to claim 5, wherein the annular hub has an exterior surface shaped as a portion of a sphere.

7. The exercise device according to claim 5, wherein the at least one wing is operable to come into rolling contact with the substantially flat surface as the exercise ball is rolled in a direction along the substantially flat surface thereby biasing the exercise ball in a direction opposing the rolling direction of the exercise ball.

8. The exercise device according to claim 5, wherein the diameter of each rib-like structure widens towards the radiating end of the rib-like structure.

9. The exercise device according to claim 5, wherein the annular band is connected to the radiating end of each rib-like structure such that the rib-like structures are held equally spaced apart from one another.

10. The exercise device according to claim 5, wherein the annular band is removably secured to the radiating end of each rib-like structure.

11. The exercise device according to claim 5, wherein each rib-like structure has a proximal end removably secured to the hub.

12. An exercise device, comprising:
a body having:
a plate-shaped central base;
rib-like structures radiating from the base, each rib-like structure:
having an exterior surface defining a longitudinal extent;
terminating into a radiating end; and
having at least one wing formed substantially parallel to the longitudinal extent and protruding away from the exterior surface to a given distance that increases along a direction towards the radiating end; and
an annular band connected to the radiating end of each rib-like structure such that the base, the rib-like structures, and the band together form a cup-shaped enclosure operable to seat therein a bottom portion of an exercise ball, the at least one wing of each rib-like structure operable to provide an incremental resistance against a rolling movement of the exercise ball along a substantially flat surface when the exercise ball is seated therein.

13. The exercise device according to claim 12, wherein the base has an exterior surface shaped as a portion of a sphere.

14. The exercise device according to claim 12, wherein the at least one wing is operable to come into rolling contact with the substantially flat surface as the exercise ball is rolled in a direction along the substantially flat surface thereby biasing the exercise ball in a direction opposing the rolling direction of the exercise ball.

15. The exercise device according to claim 12, wherein the diameter of each rib-like structure widens towards the radiating end of the rib-like structure.

16. The exercise device according to claim 12, wherein the annular band is connected to the radiating end of each rib-like structure such that the rib-like structures are held equally spaced apart from one another.

17. The exercise device according to claim 12, wherein the annular band is removably secured to the radiating end of each rib-like structure.

18. The exercise device according to claim 12, wherein each rib-like structure has a proximal end removably secured to the base.

* * * * *